United States Patent [19]

Hattori et al.

[11] Patent Number: 4,996,458

[45] Date of Patent: Feb. 26, 1991

[54] SHADOW MASK ASSEMBLY FOR COLOR CATHODE RAY TUBE

[75] Inventors: Atsushi Hattori, Nagaokakyo; Mabito Hanajima; Masaharu Moriyasu, both of Amagasaki; Toshikazu Iwamoto; Kazuhiko Matsumoto, both of Nagaokakyo, all of Japan

[73] Assignee: Mitsubishi Denki Kabushiki Kaisha, Tokyo, Japan

[21] Appl. No.: 366,179

[22] Filed: Jun. 14, 1989

[30] Foreign Application Priority Data

| | | | |
|---|---|---|---|
| Jun. 17, 1988 | [JP] | Japan | 63-150509 |
| Aug. 6, 1988 | [JP] | Japan | 63-196890 |
| Aug. 6, 1988 | [JP] | Japan | 63-196891 |
| Sep. 21, 1988 | [JP] | Japan | 63-237107 |
| Oct. 31, 1988 | [JP] | Japan | 63-276814 |
| Dec. 23, 1988 | [JP] | Japan | 63-327111 |

[51] Int. Cl.[5] ..... H01J 29/07

[52] U.S. Cl. ..... 313/402; 313/355; 313/403; 445/47

[58] Field of Search ..... 313/402, 355, 403; 445/47

[56] References Cited

U.S. PATENT DOCUMENTS

| | | | |
|---|---|---|---|
| 3,787,939 | 1/1974 | Tomita et al. | 313/402 X |
| 3,794,873 | 2/1974 | Kaplan et al. | 313/402 |
| 3,909,656 | 9/1975 | Stachniak | 313/402 |
| 4,392,914 | 7/1983 | Takenaka et al. | 313/402 X |

FOREIGN PATENT DOCUMENTS

| | | | |
|---|---|---|---|
| 43-26152 | 11/1968 | Japan . | |
| 44-3547 | 2/1969 | Japan . | |
| 47-3506 | 1/1972 | Japan . | |
| 47-40505 | 10/1972 | Japan . | |
| 51-9264 | 3/1976 | Japan . | |
| 57-138746 | 2/1981 | Japan . | |
| 0044645 | 3/1983 | Japan | 445/47 |

*Primary Examiner*—Palmer C. DeMeo

[57] ABSTRACT

A laminated shadow mask assembly for use in a color picture tube including an evacuated envelope having a longitudinal axis and also having a phosphor deposited screen lying generally perpendicular to the longitudinal axis, which assembly comprises a finely perforated, laminated shadow mask having a plurality of apertures defined therein in a predetermined pattern; a support frame for the support of the laminated shadow mask; and expansion compensating couplings disposed around the support frame for connecting the support frame in position within the evacuated envelope with the laminated shadow mask held generally parallel to the phosphor deposited screen. The finely perforated, laminated shadow mask comprises at least two perforated metal sheets each having a perforated area having minute holes defined therein and also having a non-perforated area, which minute holes in both of the perforated metal sheets form the apertures in the finely perforated, laminated shadow mask when the perforated metal sheets are connected together by means of a plurality of weld deposits formed within the perforated areas thereof to connect the perforated metal sheets firmly together.

10 Claims, 19 Drawing Sheets

Fig. 29(a)
Fig. 29(b)
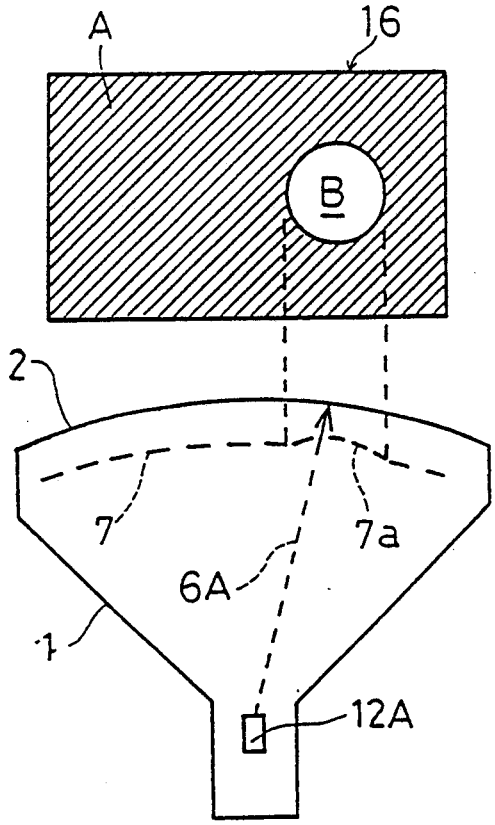
Fig. 30
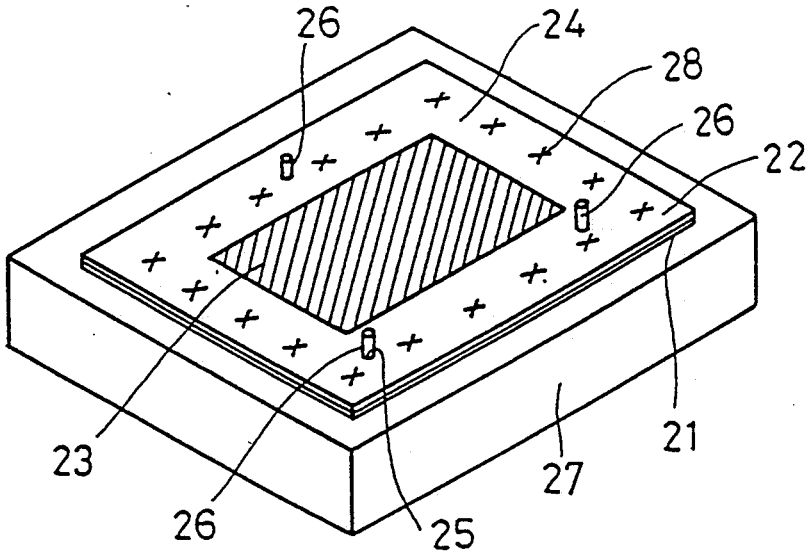

SHADOW MASK ASSEMBLY FOR COLOR CATHODE RAY TUBE

BACKGROUND OF THE INVENTION

1. Field of the Invention

The present invention generally relates to a color cathode ray tube and, more particularly, to a shadow mask assembly for use in the color cathode ray tube comprising a plurality of finely perforated metal sheets welded together and having a predetermined pattern or apertures for the passage of electron beams.

2. Description of the Prior Art

The color cathode ray tube currently available in the market generally comprises, as shown in FIG. 25 of the accompanying drawings, a highly evacuated glass envelope including a funnel section 1 continued at one end to a neck section 14, a faceplate 2 sealed to the opposite end of the funnel section 1 and having a phosphor deposited screen 3, an electron gun assembly 12 housed within the neck section 14 and including red, green and blue electron guns 12A, 12B and 12C, and a finely perforated color selection electrode member or shadow mask assembly 5 disposed inside the evacuated glass envelope in face-to-face relation with the phosphor deposited screen 3. The faceplate 2 includes a generally rectangular screen plate having a peripheral edge portion bent to provide a peripheral flange. The faceplate 2 is sealed to the funnel section 1 through the peripheral flange thereof and also includes a phosphor deposited screen 3 formed on an inner surface of the screen plate so as to confront the interior of the evacuated glass envelope. The peripheral flange of the faceplate 2 has a plurality of pins 4 secured thereto so as to protrude generally radially inwardly of the evacuated envelope 1.

The shadow mask assembly 5 includes a generally rectangular support frame 9, supported by the pins 4 as will be described later, and a similarly shaped, finely perforated shadow mask 7 having a peripheral edge portion bent to protrude in a direction counter to the screen plate thereby to define a skirt area 8. The perforated shadow mask 7 is mounted on the support frame 9 with the skirt area 8 welded to the support frame 9 by means of a plurality of, for example, 16, weld deposits. The perforated shadow mask 7 has a finely perforated area 23 and a non-perforated area 24 intervening between the perforated area 23 and the skirt area 8, said perforated area 23 of the shadow mask 7 having a multiple of apertures 13 defined therein in a predetermined pattern for the passage therethrough of respective electron beams 6A, 6B and 6C from the electron guns 12A, 12B and 12C of the electron gun assembly 12.

The perforated shadow mask assembly 5 also includes a plurality of expansion compensating couplings generally identified by 10 and interposed between the support frame 9 and the pins 4 on the peripheral flange of the faceplate 2 for compensating any possible thermal expansion, which the perforated shadow mask 7 may suffer from during the operation of the color cathode ray tube, thereby to avoid any possible mislanding of the color electron beams on the phosphor deposited screen 3. Each of the expansion compensating couplings 10 comprises a bimetal piece 15 welded to the support frame 9 and a generally elongated leaf spring 11 welded at one end to the bimetal piece 15, the opposite end of said leaf spring 11 being connected to the associated pin 4 so that the perforated shadow mask assembly 7 can be supported in position inside the evacuated envelope with the perforated shadow mask 7 held in face-to-face relation to the phosphor deposited screen 3. As a matter of practice, the phosphor deposited screen 3 is curved so as to protrude axially outwardly of the evacuated envelope and the perforated shadow mask 7 is correspondingly shaped to keep a generally parallel relationship with the phosphor deposited screen 3 when mounted inside the evacuated envelope.

In the prior art color cathode ray tube of the construction described above, the electron beams 6A, 6B and 6C emitted from the electron guns 12A, 12B and 12C pass through the fine apertures 13, defined in the perforated area 23 of the perforated shadow mask 7 and subsequently impinge upon the phosphor deposited screen 3 to excite elemental color phosphor deposits, e.g., red, green and blue phosphor deposits, on the phosphor deposited screen 3.

As is well known to those skilled in the art, the total number of the fine apertures 13 in the perforated shadow mask 7 for the passage of the electron beams occupies about 15% to about 25% of the total surface area of the perforated shadow mask 7 and, therefore, some of the electron beams travelling towards the phosphor deposited screen 3 collide against non-perforated solid portions of the perforated area 23. The consequence is that the perforated shadow mask assembly 5 is undesirably heated.

Experiments with the conventional color cathode ray tubes have shown that the perforated shawdow mask 7 and the support frame 9 tend to be heated as shown by respective curves C1 and C2 in the graph of FIG. 26. More specifically, when the color cathode ray tube is operated by the application of a high voltage of 28 kv with the beam current of 1 mA, the perforated shadow mask 7 exhibited a change in temperature thereof as shown by the curve C1 wherein the perforated shadow mask 7 underwent a considerable change in temperature for about five minutes subsequent to the start of operation of the color cathode ray tube and gained a generally steady temperature after the lapse of about 30 minutes at a value increased by about 40° C. On the other hand, since the heat capacity of the support frame 9 is higher than that of the perforated shadow mask 7, the support frame 9 was slowly heated and gained a steady temperature after the lapse of about one hour subsequent to the start of operation of the color cathode ray tube as shown by the curve C2.

Once the perforated shadow mask assembly 5 is heated in a manner as hereinabove discussed, the perforated shadow mask 7 undergoes a thermal expansion, known as "doming", to deform generally axially outwardly towards the phosphor deposited screen 3 to such an extent as to result in misalignment of the apertures with the elemental color phosphor deposits on the phosphor deposited screen 3. This misalignment causes the displacement of the electron beams impinging upon elemental color phosphor deposits from the ones upon which they were intended to impinge, that is, a mislanding of the electron beams on the phosphor deposited screen 3. This will now be discussed in detail with reference to FIG. 27.

Referring now to FIG. 27, the perforated shadow mask 7 occupying the position shown by the solid line S before the color cathode ray tube is operated is, with the increase of the temperature thereof, thermally deformed or domed in a direction axially outwardly towards the phosphor deposited screen 3 to occupy a position shown by the broken line S1 while the joint thereof with the support frame 9 remains at a fixed point W. As a result of this doming, any one of the fine apertures 13 for the passage of the electron beams, which has been located at the normal point H is displaced to a location H1 and, therefore, one of the electron beams, for example, the electron beam 6A which is emitted from the electron gun 12A and which were to impinge upon a point P on the phosphor deposited screen 3 will impinge upon a displaced point P1, resulting in the mislanding.

This type of mislanding resulting from the thermal deformation or doming of the perforated shadow mask 7 is generally characterized in that the landing points are displaced in a direction towards the center of the phosphor deposited screen 3 as shown by the arrow a, and results in the excitation of the elemental color phosphor deposits radially inwardly neighboring the elemental color phosphor deposits which ought to have been excited. This in turn brings about an incorrect color reproduction which occurs all over the picture being reproduced by the color cathode ray tube.

With the color cathode ray tube with 21-inch screen having the screen plate whose inner surface has a radius of curvature of 1,350 mm, it has been found that, when such color cathode ray tube was operated by the application of a high voltage of 28 kv with beam current of 1 mA, the landing point at which the particular electron beam should impinge upon the phosphor deposited screen 3 was displaced a distance within the range of 0.05 to 0.08 mm, accompanied by the color misalignment.

On the other hand, it has also been found that, when the support frame 9 for the support of the perforated shadow mask 7 is progressively heated approaching the steady temperature, the support frame 9 having occupied the position shown by the solid line F in FIG. 28 before the color cathode ray tube was operated was thermally expanded in a direction generally radially outwardly to occupy a different position shown by the broken line F1. Consequent upon the thermal expansion of the support frame 9, the perforated shadow mask 7 having occupied the position shown by the solid line S in FIG. 28 before the color cathode ray tube was operated was correspondingly deformed to occupy a position shown by the broken line S2 because the joint W thereof with the support frame 9 was displaced in a direction generally radially outwardly to a position shown by the broken line W1. As a result of this displacement, any one of the fine apertures 13 for the passage of the electron beams, which has been located at the normal point H shown in FIG. 28 is displaced to a location H2 and, therefore, one of the electron beams, for example, the electron beam 6A which is emitted from the electron gun 12A and which were to impinge upon a point P on the phosphor deposited screen 3 will impinge upon a displaced point P2, resulting in the mislanding.

This type of mislanding resulting from the radially outward displacement of the support frame 9 upon the thermal expansion thereof is characterized in that the landing points are displaced in a direction radially outwardly of the phosphor deposited screen 3 as shown by the arrow b, and results in the excitation of the elemental color phosphor deposits radially outwardly neighboring the elemental color phosphor deposits which ought to have been excited. In any event, as is the case with the incorrect color reproduction occurring as a result of the doming of the perforated shadow mask 7 described with reference to FIG. 27, this in turn brings about an incorrect color reproduction which occur all over the picture being reproduced by the color cathode ray tube.

In practice, the foregoing phenomena, that is, the incorrect color reproductions resulting respectively from the doming of the perforated shadow mask 7 and from the thermal expansion of the support frame 9, take place generally in combined fashion during the operation of the color cathode ray tube and, therefore, the thermal expansion of both of the perforated shadow mask 7 and the support frame 9 should be compensated for to achieve the correct color reproduction.

It is the expansion compensating couplings 10 that are used for compensating for the thermal expansions. As hereinbefore discussed with reference to FIG. 25, the expansion compensating couplings 10 are interposed between the perforated shadow mask 7 and the support frame 9 for the support thereof. Since the doming of the perforated shadow mask 7 occurs while the joint between the perforated shadow mask 7 and the support frame 9 is fixed at the position W as discussed with reference to FIG. 27, the use of the expansion compensating couplings 10 allows the joint, which occupies the position W before the operation of the color cathode ray tube, to shift to a position W3 shown in FIG. 27 so that the perforated shadow mask 7 which occupies the position S before the operation of the color cathode ray tube can be shifted generally axially towards the phosphor deposited screen 3 to a position shown by the single dotted chain line S3 in FIG. 27. This forward shift of the perforated shadow mask 7 results in a corresponding shift of the position H of the fine aperture 13 to a position H3 which is substantially aligned with the initial position H in terms of the direction of travel of such electron beam 6A towards the correct landing point P on the phosphor deposited screen 3, thereby minimizing the mislanding of the electron beam 6A.

When it comes to the support frame 9, the heating of the support frame 9 occasioned as hereinbefore discussed with reference to FIG. 28 causes the support frame 9 to expand thermally from the position F to a position shown by the broken line F1 in FIG. 28 with the fine aperture 13 consequently displaced from the point H to a different point H2 as shown in FIG. 28. However, the use of the expansion compensating couplings 10 allows the support frame 9, which occupies the position F before the operation of the color cathode ray tube, to shift in a direction close to the phosphor deposited screen 3 to a position shown by the single dotted chain line S3 in FIG. 28, accompanied by a corresponding shift of the fine aperture 13 from the point H to a point shown by the single dotted chain line H3, which point H is substantially aligned with the initial point P in terms of the direction of travel of the electron beam 6A towards the correct landing point P on the phosphor deposited screen 3, thereby minimizing the mislanding of the electron beam 6A.

The use of the bimetal piece 15 as a constituent of each of the expansion compensating couplings 10 is disclosed in, for example, the Japanese Patent Publications Examined No. 43-26152 (published in 1968), No. 44-3547 (published in 1969), No. 47-3506 (published in 1972) and No. 47-40505 (published in 1972).

However, if the color cathode ray tube is operated to reproduce a picture 16 consisting of a dark region A and a highly bright circular region B as shown in FIG. 29(*a*), a localized area 7*a* of the perforated shadow mask 7 which corresponds in position to the highly bright circular region B of the picture 16 being reproduced is heated to a temperature higher than that of the dark region A and is therefore deformed thermally to an extent larger than the remaining portion of the perforated shadow mask 7 as shown in FIG. 29(*b*). The thermal deformation of the localized portion 7*a* of the perforated shadow mask 7 is known as a localized doming and this localized doming is a cause of a localized color misalignment.

With the expansion compensating couplings 10 used hitherto in the prior art color cathode ray tubes, it has been found difficult to alleviate the localized color misalignment.

In order to eliminate the problem associated with the occurrence of the localized doming, it has been theoretically established that the use of the perforated shadow mask having an increased wall thickness is effective as disclosed in a Japanese paper entitled "Analysis of Local Doming Phenomenon of Shadow Mask Tubes" published in a bulletin of the Japanese society of television.

In general, the perforated shadow mask 7 is largely manufactured by the use of a chemical etching process such as disclosed in, for example, the Japanese Patent Publication Examined No. 51-9264 published in 1976. According to this chemical manufacturing method, a condition is added that the wall thickness t of the perforated shadow mask 7 and the size Sw of each of the fine apertures 13 for the passage therethrough of the electron beams must satisfy the relationship expressed by the following equation:

$$Sw > 0.8 \times t \quad (1)$$

It has, however, been found impossible to form such fine apertures in the metal sheet of increased thickness in a close density for the perforated shadow mask which satisfy the above described equation.

More specifically, if the elemental color phosphor deposits are formed on the inner surface of the screen plate of the faceplate 2 with minimized pitch between each neighboring elemental color phosphor deposits in order to increase the resolution of the color cathode ray tube, the fine apertures 13 for the passage of the electron beams therethrough must be correspondingly minimized in size because the perforated shadow mask 7 is responsible for the color selection.

On the other hand, in order to minimize the occurrence of the color misalignment resulting from the thermal deformation of the perforated shadow mask 7 thereby to maintain a desirable color purity, the use of the perforated shadow mask 7 having an increased wall thickness is desirable as discussed in the above mentioned bulletin.

Both of the requirement of minimizing the size of each fine aperture in the perforated shadow mask and the requirement of use of the perforated shadow mask of increased wall thickness are apparently contradictory to the relationship expressed by the foregoing equation (1). The formation of the fine apertures 13 in a single metal sheet for the perforated shadow mask 7 in order to satisfy the both is extremely difficult according to the conventional manufacturing practice as hereinbefore described.

In view of the foregoing, the use of a laminated shadow mask, i.e., the perforated shadow mask comprising a plurality of thin metal sheets welded together at their peripheral edge portions and each having a predetermined pattern of fine holes, is suggested in, for example, the Japanese Laid-open Patent Publication No. 57-138746 published in 1982. According to this publication, the stack of the thin metal sheets is said to resemble the perforated shadow mask of increased wall thickness. FIGS. 30 and 31 of the accompanying drawings illustrate a method of making the laminated shadow mask suggested in the above mentioned publication.

Again, according to the Japanese publication No. 57-138746, two perforated metal sheets 21 and 22 of FIG. 31 of different thickness each having a predetermined pattern of minute holes 13*a* and 13*b* which eventually form the fine apertures 13 for the passage of the electron beams therethrough are, as shown in FIG. 30, placed over a positioning jig 27 having a plurality of positioning pins 26 which are, when the metal sheets 21 and 22 are so mounted, engaged in respective positioning holes 25 formed in the non-perforated area 24 of each metal sheet 21 and 22 with the fine holes in one metal sheet 21 exactly aligned with those in the other metal sheet 22. While the metal sheets 21 and 22 are so retained on the positioning jig 27, the non-perforated areas 24 of the respective metal sheets 21 and 22 are welded together by the use of either a spot welding technique or a seamless welding technique.

The stack of the metal sheets 21 and 22 with the fine holes 13*a* in one metal sheet 21 aligned with the corresponding fine holes 13*b* in the other metal sheet 22 is shown in FIG. 31(*a*). After the stack is formed on the positioning jig 27 as hereinabove described, the fine holes 13*a* and 13*b* in the respective metal sheets 21 and 22 are filled up with polyamide resin 29 as shown in FIG. 31(*b*) and is then dried by the application of a heated air to allow the resin deposits 29 in the fine holes 13*a* and 13*b* to be cured for imparting a sufficient strength.

Thereafter, in a manner similar to the manufacture of the standard perforated shadow mask using the single thin metal sheet, the stack of the perforated metal sheets 21 and 22 are, as shown in FIG. 31(*c*), curved to a predetermined curvature with the use of a press comprised of male and female molds. During the stack of the perforated metal sheets 21 and 22 being subjected to the press work, the resin deposits 29 filled in the fine holes 13*a* and 13*b* serve to avoid any possible relative sliding motion between the perforated metal sheets 21 and 22 thereby to avoid any possible displacement the fine holes 13*a* in the perforated metal sheet 21 relative to the fine holes 13*b* in the perforated metal sheet 22.

Finally, as shown in FIG. 31(*d*), the resin deposits 29 in the fine holes 13*a* and 13*b* in the respective perforated metal sheets 21 and 22 are removed by fusion with the use of either a mechanical means or a laser beam.

However, it has been found extremely difficult to completely remove the resin sticked to the perforated metal sheets 21 and 22 even though the removal of the resin deposits 29 is effected subsequent to the press work and even though the resin deposits within the fine holes 13*a* and 13*b* have successfully been removed. This is because a solution of polyamide resin which eventually form the resin deposits 29 has penetrated in and has subsequently cured between the perforated metal sheets 21 and 22. Therefore, during the use of the color cathode ray tube, not only do gaseous impurities generated from the resin tend to flow out into the evacuated envelope resulting in a reduction of the lifetime of the color cathode ray tube, but also the resin remains left unremoved tend to scatter within the evacuated envelope under the influence of vibrations induced by one or more loudspeakers used in the television receiver set. It often occurs that the resin remains which have been scattered within the evacuated envelope may eventually deposit on the electron guns 12A, 12B and 12C to such an extent as to result in a sparking occurring in the electron guns 12A to 12C.

It has also been found that, because of the tendency of the stacked metal sheets 21 and 22 to restore to the original shape after the press molding, the exact alignment between the fine holes 13*a* in the perforated metal sheet 21 and the corresponding fine holes 13*b* in the other perforated metal sheet 22 tends to be destroyed.

SUMMARY OF THE INVENTION

Accordingly, the present invention has been devised with a view to providing an improved finely perforated, laminated shadow mask assembly wherein a plurality of thin perforated metal sheets are firmly welded together thereby to provide a color cathode ray tube of high resolution and capable of providing a high color purity and a prolonged lifetime.

Where the thin perforated metal sheets are welded together by the use of a welding technique, and if stresses are induced as a result of the welding, the stack of the thin perforated metal sheets, that is, the finely perforated, laminated shadow mask itself, tends to be deformed because it has a relatively low rigidity. This deformation tends to be enhanced when the stack of the perforated thin metal sheets is subjected to the press work for forming it to represent a generally spherical shape. Also, if the apertures in the finely perforated, laminated shadow mask is very minute in size and are formed at a reduced pitch between each neighboring apertures, the welding would result in a relative increase in size of portions which have been fused as a result of the welding causing the shape of each aperture for the passage of the electron beam to vary.

Accordingly, it is another object of the present invention to prevent the finely perforated, laminated shadow mask from being deformed under the influence of the stresses built up as a result of the welding.

Also, according to the previously mentioned Japanese Laid-open Patent Publication No. 57-138746, a multiple of minute holes which eventually form the fine apertures for the passage of the electron beams therethrough are formed in each of the thin metal sheets to eventually provide the laminated shadow mask. In this laminated shadow mask, the minute holes in each of the thin metal sheets are divided by reinforcement areas which are known as bridges. Because of this, if the thickness of each of the perforated metal sheets is increased, the use of the chemical etching process to form the minute holes 13*a* and 13*b* in each of the thin metal sheets 21 and 22 tends to result in an increase in width of each bridge. Should the width of each bridge be increased, the percentage of interception of the passage of the electron beams through the finely perforated, laminated shadow mask as a whole will be increased to such an extent as to result in a reduction in luminance exhibited by the phosphor deposited screen.

Yet, the presence of the bridges in the finely perforated, laminated shadow mask tends to constitute a cause of enhancement of the deformation of the finely perforated, laminated shadow mask itself during the press work employed to curve the finely perforated, laminated shadow mask to a generally spherical shape.

Accordingly, it is an additional object of the present invention to avoid any possible reduction in luminance resulting from the presence of the bridges and also to avoid any possible deformation of the finely perforated, laminated shadow mask.

In order to accomplish the above described objects of the present invention, the finely perforated, laminated shadow mask according to one preferred embodiment of the present invention comprises a plurality of perforated metal sheets each having an perforated area, in which a multiple of minute holes are formed in a predetermined pattern, and a non-perforated area, said plural metal sheets being connected together by means of a plurality of weld deposits formed in the perforated areas of the metal sheets.

According to another preferred embodiment of the present invention, the weld deposits referred to above may be formed within the perforated areas of the metal sheets in at least two circumferential rows one positioned inside the other and also within the non-perforated areas of the metal sheets in one circumferential row adjacent the outermost circumferential row of the weld deposits within the perforated areas.

According to a further preferred embodiment of the present invention, the number of the perforated metal sheets may be two, and one of the perforated metal sheets is formed with a plurality of recesses situated within the perforated area thereof. The perforated metal sheets are connected together through a plurality of weld deposits formed in the recesses, each of said weld deposit penetrating through the associated recess completely through the thickness of such one of the perforated metal sheets and then penetrating into the other of the perforated metal sheet to complete the finely perforated, laminated shadow mask. An annular groove for each weld deposit is formed on one of the opposite surfaces of such one of the perforated metal sheets that is held in contact with the other of the perforated metal sheets and is partly communicated with the adjacent minute hole in such other of the perforated metal sheets.

Said annular groove for each weld deposit may be formed on the respective surfaces of the perforated metal sheets which are held in contact with each other in alignment with the associated recess so that the corresponding weld deposit can be surrounded by the annular groove, and are partly communicated with the associated minute holes in the perforated metal sheets.

According to a still further preferred embodiment of the present invention, instead of the recesses defined in one of the perforated metal sheet, through-holes are employed each having a large diameter opening and a reduced diameter opening. The perforated metal sheets are connected together with the reduced diameter opening of each through-hole in one of the perforated metal sheet confronting the other of the perforated metal sheet, and the weld deposit is formed in each through-hole so as to extend from such one of the perforated metal sheets into the other of the perforated metal sheets to connect them firmly together.

Moreover, according to a still further preferred embodiment of the present invention, one of the perforated metal sheets has a wall thickness greater than the other of the perforated metal sheets, the thinner perforated metal sheet having a plurality of bridges while the thicker perforated metal sheet has no bridge. These perforated metal sheets are connected firmly together by means of the weld deposits each surrounded by an annular groove defined in each of the perforated metal sheets.

Where the finely perforated, laminated shadow mask comprises a plurality of perforated metal sheets each having an perforated area, in which a multiple of minute holes are formed in a predetermined pattern, and a non-perforated area, said plural metal sheets being connected together by means of a plurality of weld deposits formed in the perforated areas of the metal sheets, the perforated metal sheets can be integrated together at the respective perforated areas to such an extent that any possible relative displacement between the minute holes defined in the perforated metal sheets which would occur when the assembly is subjected to a press work to render the resultant shadow mask to represent a generally spherical shape can be effectively and positively avoided. And also, the resultant finely perforated, laminated shadow mask can have a substantial wall thickness corresponding to the sum of the respective thickness of the perforated metal sheets, enough to avoid any possible color misalignment which would result from the thermal deformation of the finely perforated shadow mask, thereby making it possible to provide a color cathode ray tube having a high color purity. Moreover, since each of the perforated metal sheets has a small thickness, fine apertures can be formed therein in a close density thereby to bring in a high resolution.

Where the weld deposits referred to above are formed within the perforated areas of the metal sheets in at least two circumferential rows one positioned inside the other and also within the non-perforated areas of the metal sheets in one circumferential row adjacent the outermost circumferential row of the weld deposits within the perforated areas, the prevention of any possible relative displacement between the minute holes in the perforated metal sheets can be enhanced.

Where one of the perforated metal sheets is formed with a plurality of recesses situated within the perforated area thereof and the perforated metal sheets are connected together through a plurality of weld deposits formed in the recesses, the volume of melt in the perforated metal sheets at each weld deposit can be reduced and, therefore, the amount of welding stresses induced during the solidification of the weld deposit can be advantageously reduced. Also, since the force induced by the welding stresses can be prevented from developing further away from the site of welding by the annular grooves, any possible deformation of the other portions of the perforated metal sheets than the weld deposits can be suppressed. Therefore, the finely perforated, laminated shadow mask can exhibit a minimized deformation.

Also, since the annular grooves are partly communicated with the apertures in the finely perforated, laminated shadow mask, gaseous impurities which would be generated during the welding can be discharged to the outside before the finely perforated, laminated shadow mask according to the present invention is installed inside the envelope of the color cathode ray tube. Therefore, the evacuated atmosphere, that is, a vacuum, can be maintained in the envelope and, also, the lifetime of the color cathode ray tube employing the finely perforated, laminated shadow mask according to the present invention can be prolonged.

Where, instead of the recesses defined in one of the perforated metal sheet, through-holes are employed each having a large diameter opening and a reduced diameter opening, the volume of melt in the perforated metal sheets at each weld deposit can be still smaller and, therefore, the welding stresses which tend to be generated during the solidification can be minimized thereby to accomplish the rigid connection of the perforated metal sheets together without being accompanied by any possible deformation.

Yet, where the annular grooves are formed so as to surround the weld deposits, transmission of the force induced by the welding stresses will be barred by the annular grooves thereby to minimizing any possible deformation of the finely perforated, laminated shadow mask according to the present invention. In addition, since the thicker perforated metal sheet is not provided with any bridge, no unnecessary deformation may occur in the thicker perforated metal sheet during the press work effected subsequent to the welding. Also, the absence of the bridges in the thicker perforated metal sheet is effective to minimize the stresses which tend to be generated as a result of the difference in position of the neutral axes of bending of both of the perforated metal sheets during the press work.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined solely by the appended claims. In the accompanying drawings, like reference numerals are used to denote like parts throughout the several views, and:

FIG. 11(*b*) is a cross-sectional representation of the finely perforated, laminated shadow mask shown in FIG. 11;

FIG. 29(*a*) is a schematic front elevational view of the phosphor deposited screen of the color cathode ray tube, which view is used to explain the localized doming occurring in the perforated shadow mask;

FIG. 29(*b*) is a schematic top plan view of the color cathode ray tube showing the occurrence of the localized doming where an image produced on the phosphor deposited screen is such as shown in FIG. 29(*a*);

FIG. 30 is a schematic perspective view showing a positioning jig forming a part of a press used to shape the perforated shadow mask, illustrating the prior art method of shaping the perforated shadow mask.

DETAILED DESCRIPTION OF THE EMBODIMENTS

Figure 1:
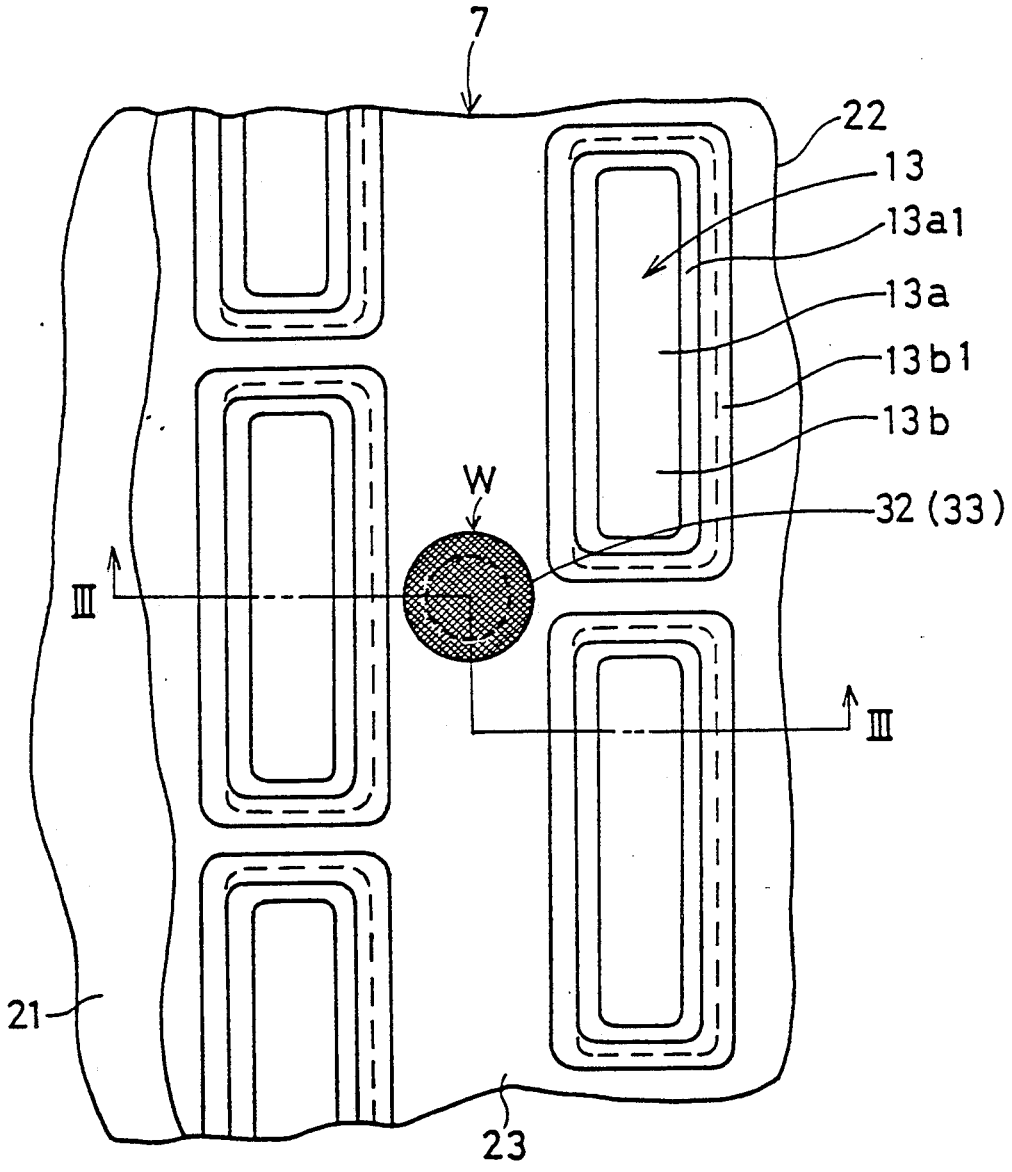
FIG. 1 is an exaggerated plan view of a portion of a finely perforated, laminated shadow mask according to a first preferred embodiment of the present invention.
Figure 2:
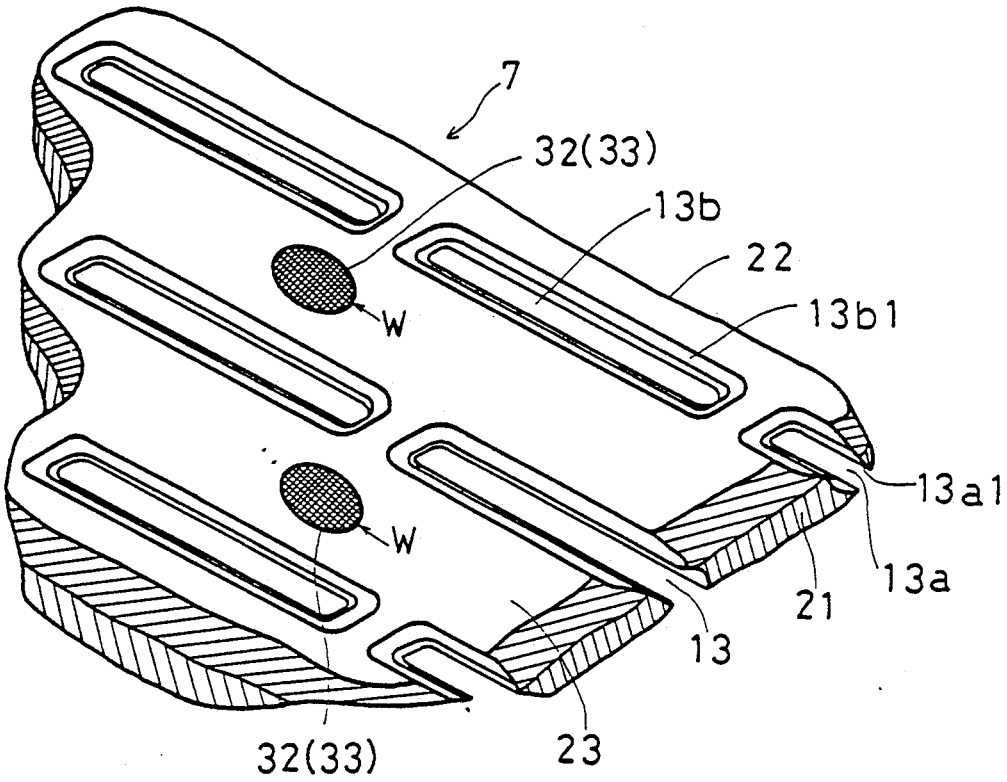
FIG. 2 is a perspective view of that portion of the finely perforated, laminated shadow mask shown in FIG. 1.

FIGS. 1 and 2 illustrate an enlarged plan view and a perspective view of a portion of a perforated shadow mask assembly according to a first preferred embodiment of the present invention as viewed from a phosphor deposited screen, respectively. The highly evacuated envelope in which the perforated shadow mask assembly according to the present invention is housed is identical with that shown in and described with reference to FIG. 25 and, therefore, reference may be made to FIG. 25 for the details of the highly evacuated envelope used in combination with the perforated shadow mask assembly of the present invention.

Figure 3:
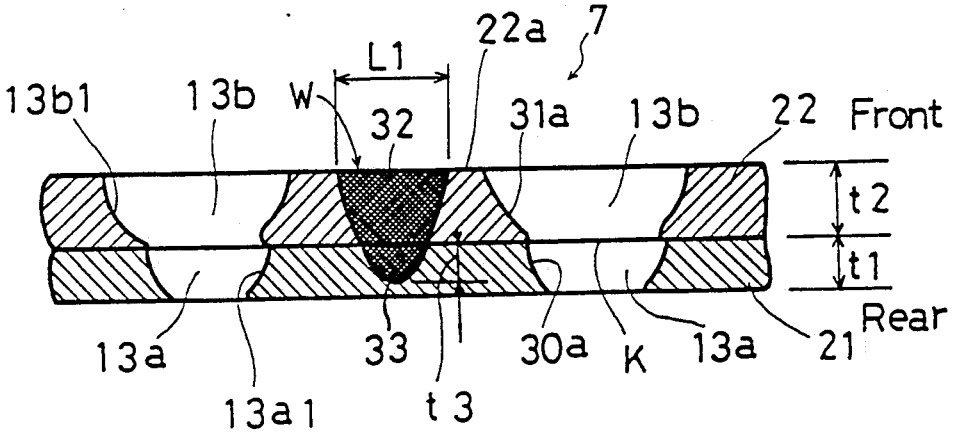
FIG. 3 is a cross-sectional view taken along the line III—III in FIG. 1.

Referring now to FIG. 1, the perforated shadow mask 7 embodying the present invention comprises a relatively thin first or rear metal sheet 21 and a second or front metal sheet 22 positioned on respective sides close to and remote from the electron gun assembly 12. As best shown in FIGS. 2 and 3, the front and rear metal sheets 21 and 22 have respective predetermined pattern of minute holes 13*a* and 13*b* in the form of slots, which eventually form the minute apertures 13 for the passage of the electron beams therethrough, and are stacked one above the other with the minute slots 13*a* in the rear metal sheet 21 aligned with the corresponding slots 13*b* in the front metal sheet 22. The front perforated metal sheet 22 is disposed in the vicinity of the phosphor deposited screen 3, which plays an important role in thermal conduction, and has a greater wall thickness t2, shown in FIG. 3, than the wall thickness t1, shown in FIG. 3, of the rear perforated metal sheet 21 for the purpose of reinforcing the rear perforated metal sheet 21. Both of the rear and front perforated metal sheets 21 and 22 are made of, for example, aluminum killed steel.

Each slot 13*b* defined by a corresponding surrounding wall 13*b*1 in the front perforated metal sheet 22 is somewhat oversized relative to each slot 13*a* defined by a corresponding surrounding wall 13*a*1 in the rear perforated metal sheet 21, thereby ensuring surface area for the passage of the electron beams defined by the slots 13*a* of the rear sheet 21 even when the slots 13*b* of the front sheet 22 are not well aligned with the slots 13*a* of the rear sheet 21.

The front and rear perforated metal sheets 22 and 21 stacked one above the other are welded together by means of a plurality of weld deposits W each including a weld fraction 32 penetrating completely through the front perforated metal sheet 22 from a front surface 22*a* thereof and a weld fraction 33 continued from the weld fraction 32 and penetrating into the rear perforated metal sheet 21 to a predetermined depth shown by t3 in FIG. 3.

Figure 4:
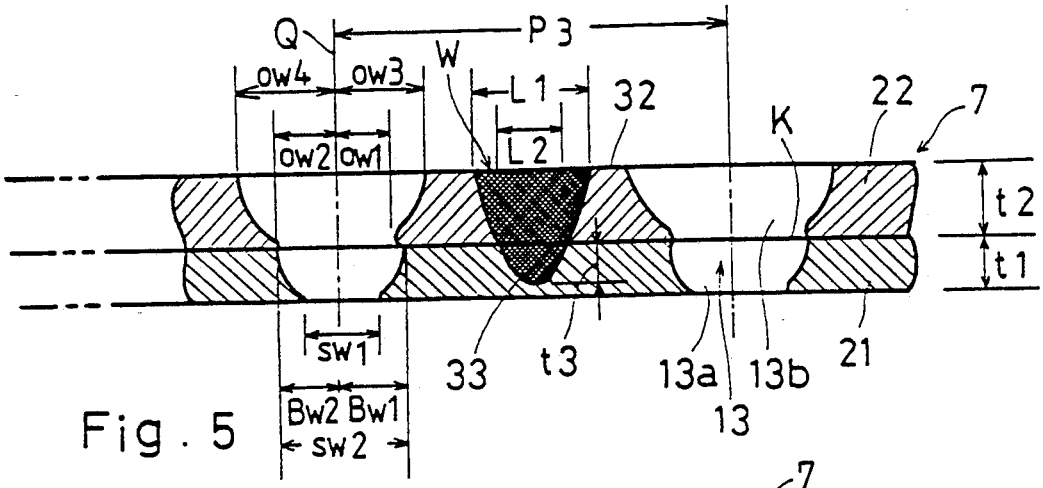
FIG. 4 is a view similar to FIG. 3, showing the various dimensions of the finely perforated, laminated shadow mask to be employed in a 21-inch color cathode ray tube.

FIG. 4 illustrates the various dimensions of the component parts of the finely perforated, laminated shadow mask 7 manufactured on a trial basis for use in the 21-inch color cathode ray tube. In FIG. 4, reference character P3 represents the pitch between each neighboring slot-shaped apertures 13 in the finely perforated, laminated shadow mask 7 as measured in a direction conforming to the widthwise direction thereof and is 0.65 mm. The wall thicknesses t1 and t2 of the rear and front perforated metal sheets 21 and 22 are 0.20 mm and 0.25 mm, respectively. Each slot 13*a* in the rear perforated metal sheet 21 has a minimum width Sw1 of 150 μm as measured on a rear surface thereof and a maximum width Sw2 as measured on the opposite front surface thereof held in contact with the front perforated metal sheet 22, which maximum width Sw2 is greater than the minimum width Sw1. In other words, the surrounding wall 13*a*1 defining and surrounding each slot 13*a* is so shaped as to progressively reduce the width of such slot 13*a* from the front surface thereof towards the rear surface thereof.

The width of each of the slots 13*a* and 13*b* formed in the rear and front perforated metal sheets 21 and 22 progressively varies with increase of the distance away from the center of the finely perforated, laminated shadow mask 7 which is generally in alignment with the longitudinal axis of the highly evacuated envelope. By way of example, at a position 150 mm away from the center of the finely perforated, laminated shadow mask 7 in a direction conforming to the widthwise direction thereof, and if expressed in terms of a distance from the imaginary line passing through the center intermediate of the width Sw1 of the slot 13*a* and othogonal to the rear perforated metal sheet 21, Bw1 and Bw2 in the rear perforated metal sheet 21 may be 160 μm and 120 μm, respectively, and Ow1, Ow2, Ow3 and 0w4 in the front perforated metal sheet 22 may be 150 μm, 120 μm, 250 μm and 170 μm, respectively. In general, the width of each slot 13*b* in the front perforated metal sheet 22 is selected to be greater than that of the associated slot 13*a* in the rear perforated metal sheet 21 so that any possible variation in the surface area for the passage of the electron beams which would result from a variation in the manufacture of the finely perforated, laminated shadow mask 7 can be minimized or substantially eliminated.

Figure 7:
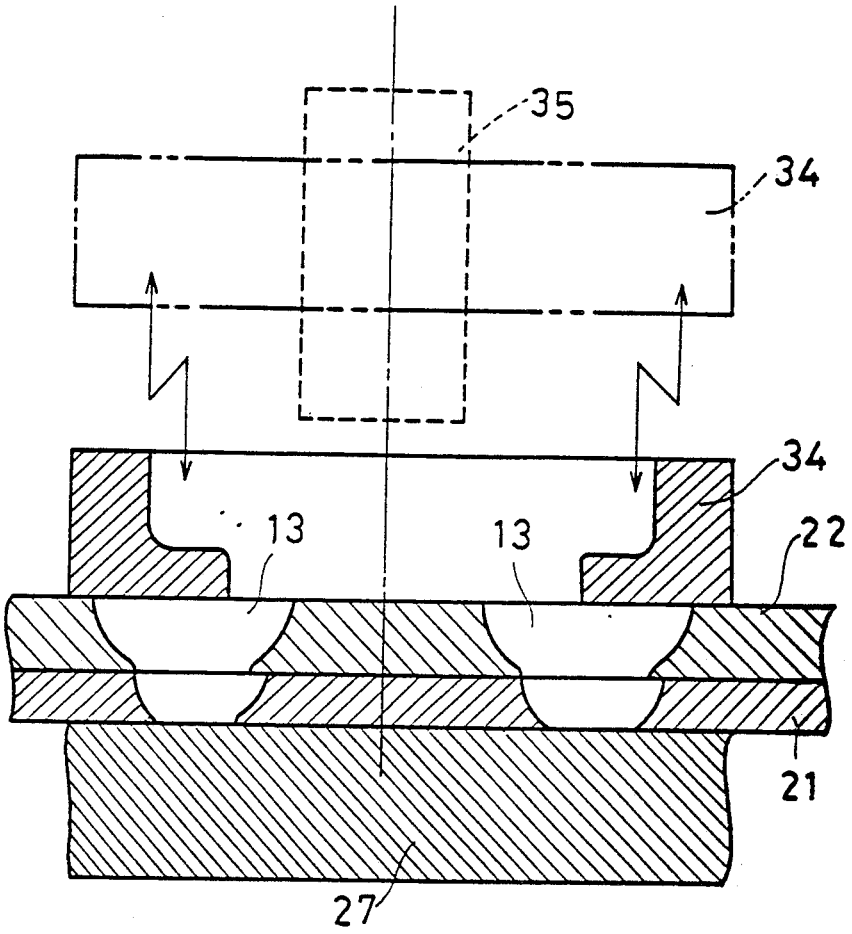
FIG. 7 is a sectional view, on an enlarged scale, of a portion of the finely perforated, laminated shadow mask, showing the manner by which thin perforated metal sheets are welded together according to the first preferred embodiment of the present invention.

To complete the finely perforated, laminated shadow mask 7 according to the present invention, the front and rear perforated metal sheets 22 and 21 having the respective slots 13*b* and 13*a* so defined therein as hereinbefore described are placed on the positioning jig 34 in a stacked fashion and the front and rear perforated metal sheets 22 and 21 on the positioning jig 34 are subsequently pressed together by means of a pressing jig 34 as shown in FIG. 7. The front and rear perforated metal sheets 22 and 21 are pressed together by the application of an external force of 4 $Kg/cm^2$ so firmly as to hold them in tight contact with each other with no space formed therebetween. While the front and rear perforated metal sheets 22 and 21 are maintained as firmly sandwiched between the positioning jig 27 and the pressing jig 34, welding is effected to permanently connect the front and rear perforated metal sheets 22 and 21 together by radiating a YAG laser beam under a condition of, for example, 0.6 to 0.8 joules per pulse of about 10 milliseconds in pulse duration to form a plurality of weld deposits, which beam is converged by a laser processing head to give the laser beam of 0.1 to 0.15 in beam size (diameter). It is to be noted that each of the resultant weld deposits, generally identified by W, is comprised of the weld fraction 32 penetrating completely through the front perforated metal sheet 22 from the front surface 22*a* thereof and the weld fraction 33 continued from the weld fraction 32 and penetrating into the rear perforated metal sheet 21 to a predetermined depth shown by t3 in FIG. 3.

When performing the welding by the application of the laser beam, it is recommended that, as shown in FIG. 4, the maximum diameter L1 of each weld fraction 32 situated on the front surface 22*a* (FIG. 3) of the front perforated metal sheet 22 is about 0.3 mm, the diameter L2 of each weld fraction 33 situated on the surface of the rear perforated metal sheet 21 which is held in contact with the front perforated metal sheet 22 is about 0.1 mm, and the depth t3 of each weld fraction 33 is about 0.1 mm.

Figure 5:
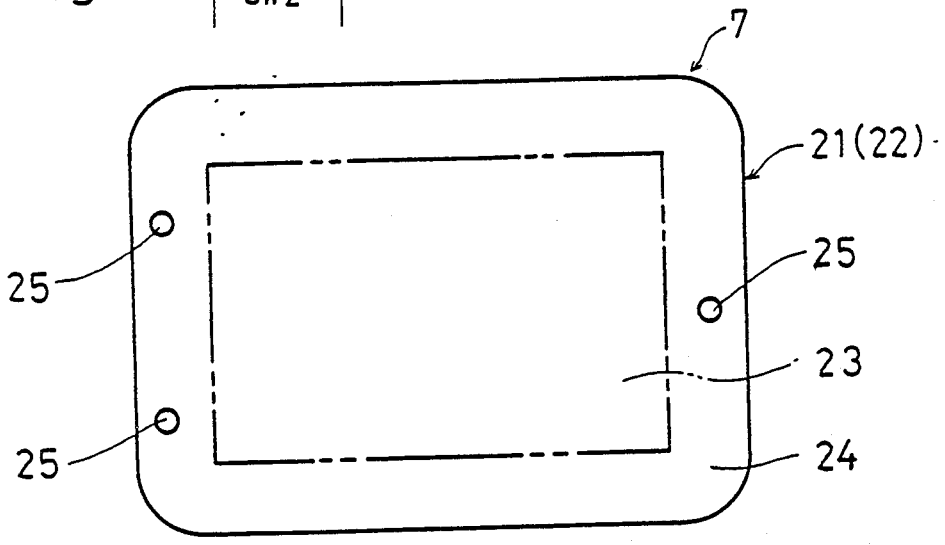
FIG. 5 is a schematic plan view of the finely perforated, laminated shadow mask employed in the first preferred embodiment of the present invention.

Also, in the case of the finely perforated, laminated shadow mask 7 for use in the 29-inch color cathode ray tube, the welding is carried out in such a manner that a plurality of, for example, 50, weld deposits W can be formed in the non-perforated area 24 peripheral to the perforated area 23 with each neighboring members of said weld deposits W in the non-perforated area 24 being spaced at a pitch of 40 mm and a plurality of, for example, 100, weld deposits W can also be formed in the perforated area 23 with each neighboring members of said weld deposits in the perforated area 23 being spaced at a pitch of about 30 to 100 mm, said non-perforated and perforated areas 24 and 23 being also indicated in FIG. 5.

The stack of the rear and front perforated metal sheets 21 and 22 welded together in the manner as hereinabove described is substantially pressed to represent a curved shape, thereby completing the finely perforated, laminated shadow mask 7 according to the present invention. The finely perforated, laminated shadow mask 7 comprising the plural metal sheets 21 and 22 and designed for use in the 29-inch color cathode ray tube as hereinabove described has been found satisfactory in that the occurrence of any possible displacement of the slots 13*a* in the rear metal sheet 21 relative to the slots 13*b* in the front metal sheet 22 which would result from the relative slide and/or elongation of those metal sheets 21 and 22 could be reduced very extremely.

Hereinafter, a method of making the finely perforated, laminated shadow mask 7 according to the present invention will be described with particular reference to FIGS. 5 to 8.

FIG. 5 illustrates a schematic plan view of the rear and front perforated metal sheets 21 and 22 each having been prepared by the use of a chemical etching technique to have a predetermined or desired wall thickness. As shown therein, each of the rear and front perforated metal sheets 21 and 22 has its non-perforated area 24 formed with a plurality of, for example, three, positioning holes 25 for receiving the positioning pins 26 (FIG. 6), integral or fast with the positioning jig 27, so that one of the rear and front perforated metal sheets 21 and 22 can be subsequently aligned with the other of the rear and front perforated metal sheets 21 and 22 with the slots 13*a* in the rear perforated metal sheet 21 held in register with the slots 13*b* in the front perforated metal sheet 22.

Figure 6:
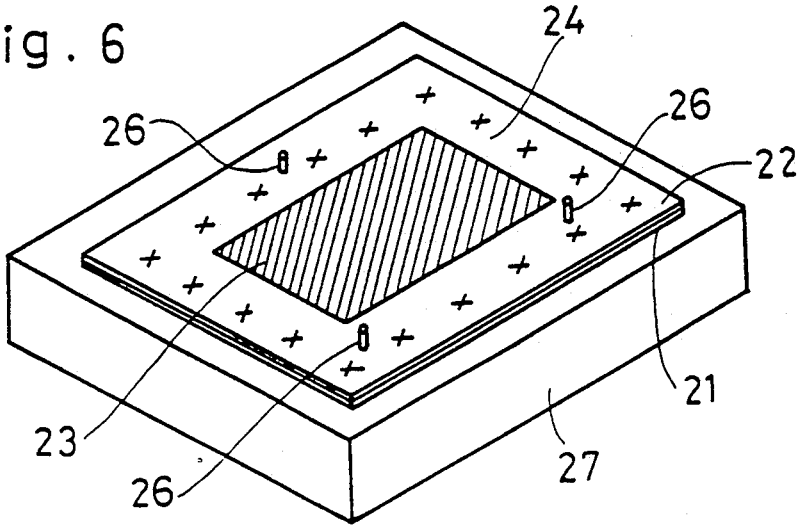
FIG. 6 is a schematic perspective view of a positioning jig used to form the finely perforated, laminated shadow mask of the present invention.

The rear and front perforated metal sheets 21 and 22 having the positioning holes 25 defined in their nonperforated areas 24 are then placed on the positioning jig 27 as shown in FIG. 6 with the positioning pins 26 passing through the positioning holes 25 thereby to align the rear and front perforated metal sheets 21 and 22 with each other. Of course, upon the placement of the rear and front perforated metal sheets 21 and 22 on the positioning jig 27, the slots 13*a* defined in the perforated area 23 of the rear perforated metal sheet 21 are aligned or substantially aligned with the corresponding slots 13*b* defined in the perforated area 23 of the front perforated metal sheet 22.

Thereafter, as shown in FIG. 7, the stack of the rear and front perforated metal sheets 21 and 22 resting on the positioning jig 27 is allowed to be firmly sandwiched between the positioning jig 27 and the pressing jig 34 under a predetermined pressure to hold the rear and front perforated metal sheets 21 and 22 in tight contact with each other with no void formed between the rear and front perforated metal sheets 21 and 22. While in this condition, the laser processing head 35 is positioned relative to the assembly including the stack of the rear and front perforated metal sheets 21 and 22 sandwiched between the positioning and pressing jigs 27 and 34 and a laser beam is then radiated from the laser processing head 35 to connect the rear and front perforated metal sheets 21 and 22 together in the manner as hereinbefore discussed. After the welding so performed by the radiation of the laser beam, the pressing jig 34 is elevated to release the pressing force which has been applied to the stack of the rear and front perforated metal sheets 21 and 22 in cooperation with the positioning jig 27, followed by the removal of the integrated rear and front perforated metal sheets 21 and 22, thereby completing the finely perforated, laminated shadow mask 7 according to the present invention.

Figure 8:
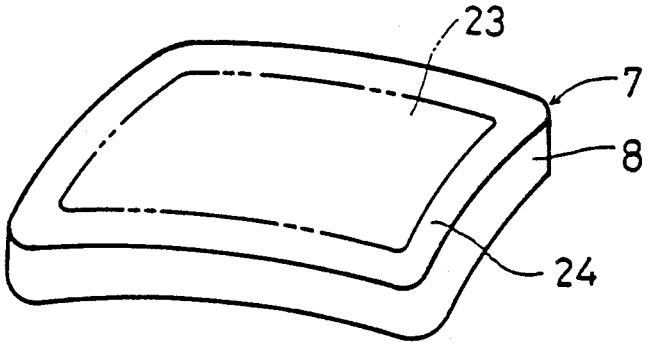
FIG. 8 is a schematic perspective view of the finely perforated, laminated shadow mask which has been shaped by the use of a press work.

The finely perforated, laminated shadow mask 7 so formed is subsequently pressed to represent a generally spherical shape as shown in FIG. 8. During this press work, an outer peripheral area of the finely perforated, laminated shadow mask 7 is simultaneously bent to provide the skirt 8.

According to the foregoing preferred embodiment of the present invention, since the finely perforated, laminated shadow mask 7 is formed of the two perforated metal sheets 21 and 22 in the laminated fashion, the finely perforated, laminated shadow mask 7 has a substantially increased wall thickness corresponding to the sum of the thicknesses of the perforated metal sheets 21 and 22 and, therefore, any possible thermal deformation, particularly the localized doming, of the finely perforated, laminated shadow mask which would result from the impingement of some of the electron beams thereagainst can be effectively minimized as theoretically proved in the previously mentioned bulletin published by the Japanese society of television. Thus, with the finely perforated, laminated shadow mask according to the present invention incorporated in the color cathode ray tube, the color cathode ray tube can exhibit a favorable color purity.

Also, according to the foregoing embodiment of the present invention, since the plural perforated metal sheets 21 and 22 are welded together with the plural weld deposits formed in the perforated areas 23 thereof, the perforated area 23 of one of the perforated metal sheets 21 and 22 can be so integrated together with the perforated area 23 of the other of the perforated metal sheets 21 and 22 that the tendency of the perforated metal sheets 21 and 22 to restore to the initial shape under the influence of stresses built up during the press molding can be effectively minimized thereby to avoid any possible displacement and/or separation of one of the perforated metal sheets 21 and 22 relative to the other of the perforated metal sheets 21 and 22. Thus, the shadow mask 7 having fine apertures in a close density and effective to permit the color cathode ray tube to exhibit a high resolution can be obtained wherein the plural perforated metal sheets 21 and 22 are firmly retained in position.

Furthermore, unlike the prior art in which the resin deposits 29 are filled in the holes 13*a* and 13*b* in the metal sheets such as shown in and described with reference to FIG. 31, the present invention does not make use of the resin deposits and, therefore, the possibility of occurrence of sparking attributable to the resin remains can be advantageously eliminated, permitting the resultant color cathode ray tube to have a prolonged lifetime.

In describing the foregoing embodiment with reference to FIGS. 1 to 8, reference has been made to the use of the two, i.e., rear and front, perforated metal sheets 21 and 22. However, the number of the perforated metal sheets may not be always limited to two such as shown and described, but three perforated metal sheets may be employed such as shown by 20, 21 and 22 in FIG. 9 for the finely perforated, laminated shadow mask 7.

Figure 9:
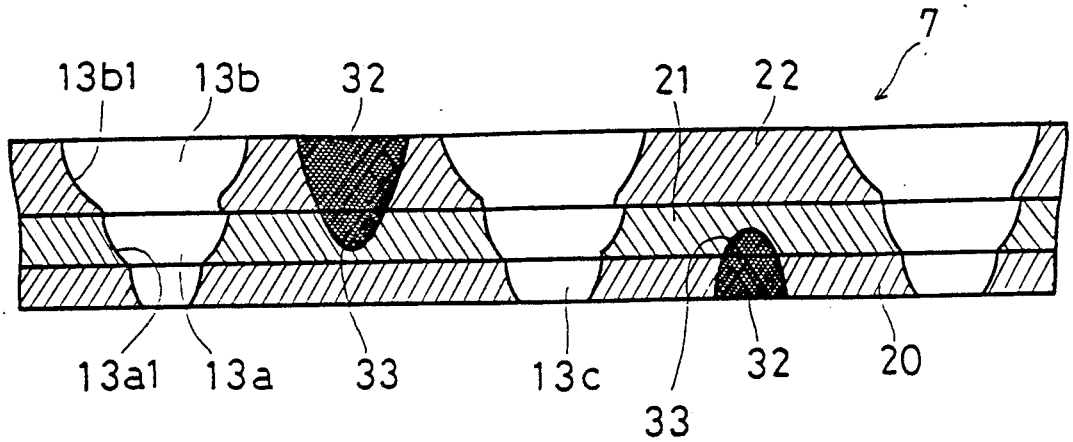
FIG. 9 is a view similar to FIG. 3, showing a modification of the first preferred embodiment of the present invention.

According to the modification shown in FIG. 9, one of the perforated metal sheets which is closest to the electron gun assembly 12 (FIG. 1) or the sheet 20, has the smallest wall thickness of all and has defined therein a corresponding number of slots 13*c* each having the smallest width as compared with that in any one of the other perforated metal sheets 21 and 22. Even with the finely perforated, laminated shadow mask 7 using the three perforated metal sheets 20 to 21, effects similar to those described in connection with the finely perforated, laminated shadow mask 7 using the two perforated metal sheets can be appreciated.

Hereinafter, a second preferred embodiment of the present invention will be described with reference to FIGS. 10 and 11 which show a top plan view of the stack of the perforated metal sheets 21 and 22 before it is pressed to represent a generally spherical shape and a plan view of the resultant finely perforated, laminated shadow mask after the press work, respectively.

In this second preferred embodiment of the present invention, the first and second perforated metal sheets 21 and 22 are integrated together by the weld deposits which are formed within the perforated area 23 in two generally rectangular rows Wp1 and Wp2 and within the non-perforated area 24 in a single generally rectangular row Wp3 extending along the perimeter between the non-perforated and perforated areas 23 and 24. Other than the manner in which the weld deposits are formed, the resultant finely perforated, laminated shadow mask 7 according to this embodiment is substantially identical with that according to the foregoing embodiment and, therefore, the details thereof will not be reiterated for the sake of brevity.

The application of the present invention as represented by the second preferred embodiment to a 21-inch color cathode ray tube will now be described.

Figure 10:
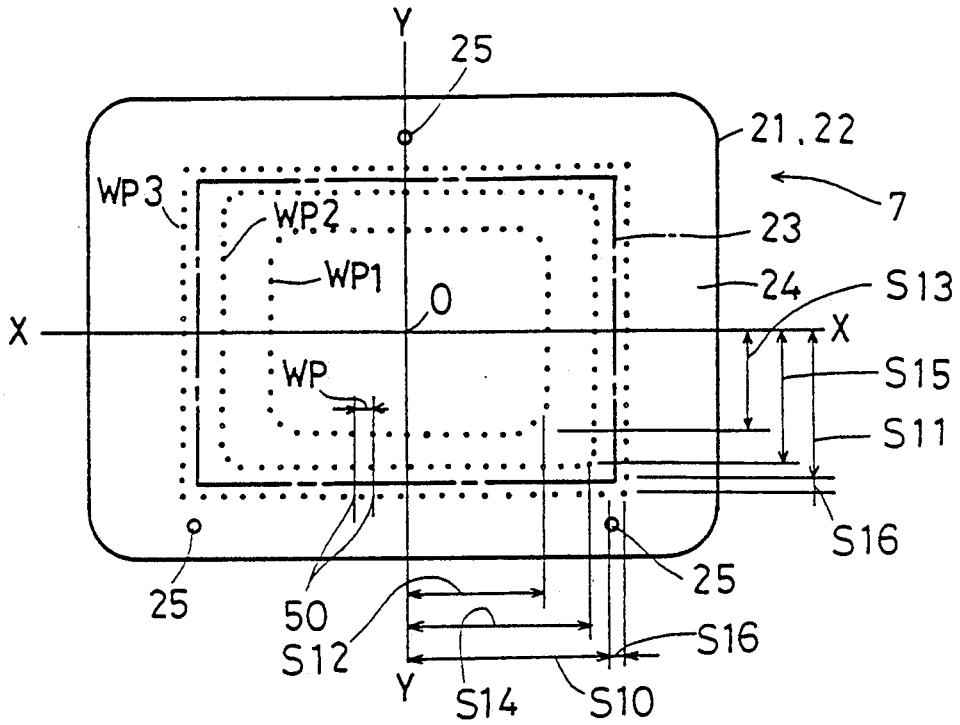
FIG. 10 is a top plan view of the finely perforated, laminated shadow mask according to a second preferred embodiment of the present invention, which mask is shown in a condition before being press-molded.
Figure 11:
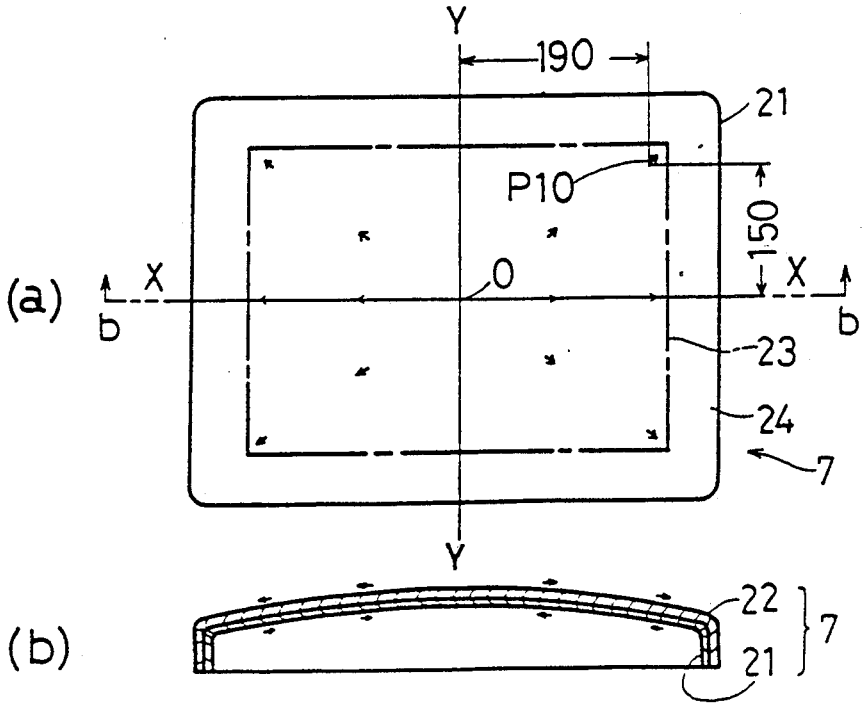
FIG. 11(*a*) is a top plan view of the finely perforated, laminated shadow mask after having been pressmolded, indicating the direction of displacement of minute holes formed in each of the perforated metal sheets.

Referring to FIG. 10, in the case of the 21-color cathode ray tube, the distance S10 from the center 0 of the finely perforated, laminated shadow mask 7 to either side of the perforated area 23 as measured along the horizontal axis X perpendicular to and extending across the longitudinal axis of the evacuated envelope, that is, half the width of the perforated area 23, is 195 mm while the distance S11 from the center 0 of the finely perforated, laminated shadow mask 7 to either top or bottom of the perforated area 23 as measured along the vertical axis Y extending across the longitudinal axis of the evacuated envelope and perpendicular to any one of the horizontal axis X and the longitudinal axis of the evacuated envelope, that is, half the height of the perforated area 23, is 155 mm.

As hereinbefore described, the first and second perforated metal sheets 21 and 22 are integrated together by means of the rectangular rows Wp1 and Wp2 of the weld deposits situated within the perforated area 23 and also by means of the rectangular row Wp3 of the weld deposits situated within the non-perforated area 24 in the vicinity of the perimeter between the perforated and non-perforated areas 23 and 24. In particular, the rectangular row Wp1 of the weld deposits is so positioned within the perforated area 23 that either side of the rectangular row Wp1 is spaced a distance S12 of 130 mm from the center 0 of the finely perforated, laminated shadow mask 7 as measured along the horizontal axis X and either top or bottom of the rectangular row Wp1 is spaced a distance S13 of 105 mm from the center 0 of the finely perforated, laminated shadow mask 7 as measured along the vertical axis Y, while the weld deposits in the rectangular row Wp1 are spaced a pitch WP of 10 mm from each other. Similarly, the rectangular row Wp2 of the weld deposits is so positioned within the perforated area 23 that either side of the rectangular row WP2 is spaced a distance S14 of 175 mm from the center 0 of the finely perforated, laminated shadow mask 7 as measured along the horizontal axis X and either top or bottom of the rectangular row Wp2 is spaced a distance S15 of 140 mm from the center 0 of the finely perforated, laminated shadow mask 7 as measured along the vertical axis Y, while the weld deposits in the rectangular row Wp2 are spaced a pitch WP of 10 mm from each other. Also, the rectangular row Wp3 of the weld deposits is so positioned within the non-perforated area 24 that either side of the rectangular row Wp3 is spaced a circumferentially uniform distance S16 of 5 mm radially outwardly from the perimeter between the perforated and non-perforated areas 23 and 24, while the weld deposits in the rectangular row Wp3 are spaced a pitch WP of 10 mm from each other.

The stack of the first and second perforated metal sheets 21 and 22 is then subjected to the press work, in a manner similar to that described in connection with the first preferred embodiment of the present invention, to render it to represent a generally spherical shape, thereby to complete the finely perforated, laminated shadow mask 7. With the use of the finely perforated, laminated shadow mask 7 so prepared as hereinabove described, the amount of displacement of the minute holes 13*a* in the first preforated metal sheet 21 relative to the minute holes 13*b* in the second perforated metal sheet 22 was measured. As a result of the measurement, it has been found that the maximum displacement of 10 μm was found at a location P10 at each corner region of the perforated area 23, spaced 190 mm from the center 0 along the horizontal axis X and 150 mm from the center 0 along the vertical axis Y as indicated in FIG. 11(*a*). Such a magnitude of displacement is within the acceptable tolerance and, therefore, the resultant finely perforated, laminated shadow mask 7 can be practically utilizable in the color cathode ray tube. It is to be noted that arrow-headed lines in FIG. 11(*a*) represent the direction of relative displacement between the first and second perforated metal sheets 21 and 22.

When the pitch WP between each neighboring weld deposits in each of the rectangular rows Wp1, Wp2 and Wp3 was chosen to be one of 5 mm, 10 mm and 20 mm, the measurement of the maximum relative displacement Δwp between the minute holes 13*a* and 13*b* in the first and second perforated metal sheets 21 and 22 showed the following results as tabulated in Table below.

TABLE

| | Welding Pitch WP (mm) | | |
|---|---|---|---|
| | 5 | 10 | 20 |
| Maximum Displacement Δwp (μm) | 2 | 10 | 35 |

The results of the measurement tabulated above indicates that the employment of the welding pitch WP not greater than 15 mm is desirable, since the maximum relative displacement Δwp is suppressed in the value smaller than 20 μm with the welding pitch Wp not greater than 15 mm.

Although in the foregoing second preferred embodiment of the present invention the welding deposits have been described and shown as formed in the two rectangular rows Wp1 and Wp2 within the perforated area 23 and the single rectangular row Wp3 within the non-perforated area 24, the present invention may not be always limited thereto and the number of the rectangular rows of the weld deposits within the perforated area 23 may be greater than two and/or the number of the rectangular rows of the weld deposit within the non-perforated area 24 may be greater than one. Furthermore, welding deposits may be scattered across the perforated area 23 and non-perforated area 24 rather than being formed in the rectangular row such as described in the second preferred embodiment.

Also, in the foregoing second preferred embodiment of the present invention, the innermost rectangular row Wp1 of the weld deposits has been shown as formed at a location spaced radially outwardly from the center 0 a distance equal to about two thirds of the distance between the center 0 and the perimeter between the perforated and non-perforated areas 23 and 24. However, the innermost rectangular row Wp1 of the weld deposits may be formed at a location further radially inwardly of the illustrated location, for example, at a location spaced radially inwardly from the center 0 a distance not smaller than one third of the distance from the center 0 to the perimeter between the perforated and non-perforated areas 23 and 24.

Again, although the welding pitch WP of the weld deposits in the rectangular row Wp3 in the non-perforated area 24 has been shown and described as equal to the welding pitch WP of the weld deposits in any one of the rectangular rows Wp1 and Wp2 in the perforated area 23, the welding pitch WP of the weld deposits in the rectangular row Wp3 may be different from the welding pitch WP of the weld deposits in any one of the rectangular rows Wp1 and Wp2.

Hereinafter, some of results of experiments which eventually resulted in the present invention as represented by the second preferred embodiment will be described as comparative examples for the purpose of illustration of the present invention.

COMPARATIVE EXAMPLE 1

When only the rectangular row Wp3 of the weld deposits was formed to connect the first and second perforated metal sheets 21 and 22 which were subsequently subjected to the press work to complete the generally spherically curved finely perforated, laminated shadow mask 7, the maximum relative displacement Δwp between the minute holes 13*a* and 13*b* defined in the first and second perforated metals sheets 21 and 22, respectively, was found to have occurred at each corner regions of the perforated area 23 of the finely perforated, laminated shadow mask 7 as is the case with the experiments which have resulted in the data shown in the previously mentioned table, the magnitude of which was 150 μm.

The result of the experiment wherein only the rectangular row Wp3 was formed as described above indicates that the relative displacement between the minute holes 13*a* and 13*b* in the respective first and second perforated metal sheets 21 and 22, which would occur when the stack of the perforated metal sheets 21 and 22 is press-molded is not determined in terms of the difference in position of the neutral axes of bending of both of the first and second perforated metal sheets 21 and 22 during the press work, but will vary considerably depending on the physical strength determined by the width of each of the bridges in each of the first and second perforated metal sheets 21 and 22.

COMPARATIVE EXAMPLE 2

When the rectangular row Wp3 of the weld deposits and the rectangular row Wp1 of the weld deposits at the pitch WP of 5 mm were formed to connect the first and second perforated metal sheets 21 and 22 which were subsequently subjected to the press work to complete the generally spherically curved finely perforated, laminated shadow mask 7, the maximum relative displacement Δwp between the minute holes 13*a* and 13*b* defined in the first and second perforated metal sheets 21 and 22, respectively, was found to have occurred at each corner regions of the perforated area 23 of the finely perforated, laminated shadow mask 7 as is the case with the Comparative Example 1, the magnitude of which was 55 μm.

In the practice of the second preferred embodiment of the present invention, more than the two perforated metal sheets 21 and 22 may be employed. Where the three or more perforated metal sheets are employed for the fabrication of the finely perforated, laminated shadow mask, the apertures 13 for the passage of the electron beams therethrough can be further reduced in size so that the resultant color cathode ray tube can exhibit a high resolution and a high thermal resistance.

Figure 12:
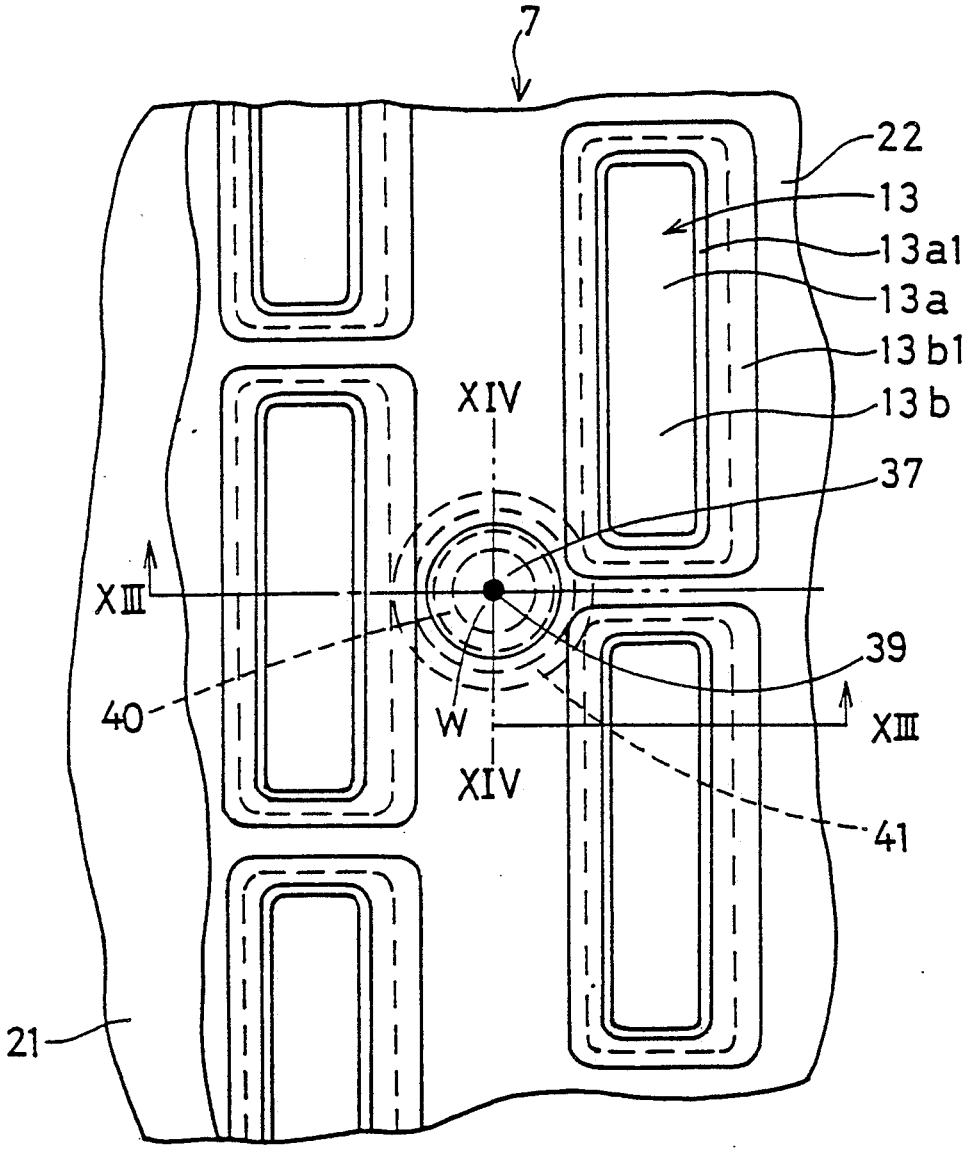
FIG. 12 is an exaggerated plan view of a portion of the finely perforated, laminated shadow mask according to a third preferred embodiment of the present invention.

A third preferred embodiment of the present invention will now be described with particular reference to FIGS. 12 to 14. FIG. 12 is an exaggerated top plan view of a portion of the finely perforated, laminated shadow mask according to this third embodiment of the present invention FIG. 13 is a cross-sectional view taken along the line XIII—XIII in FIG. 12 and FIG. 14 is a cross-sectional view taken along the line XIV—XIV in FIG. 12.

Figure 13:
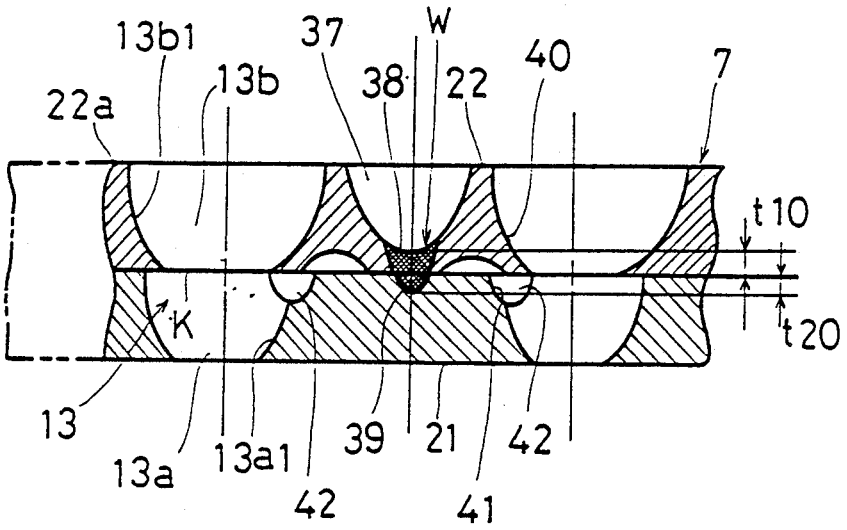
FIG. 13 is a cross-sectional view taken along the line XIII—XIII in FIG. 12.
Figure 14:
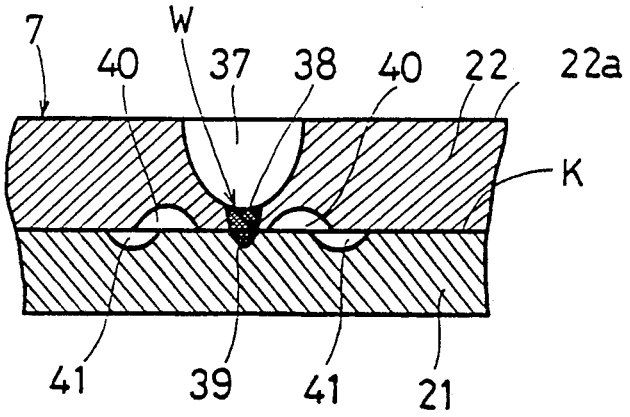
FIG. 14 is a cross-sectional view taken along the line XIV—XIV in FIG. 12.

Referring now to FIGS. 12 to 14, reference numeral 37 represents one of a plurality of recesses formed in the second perforated metal sheet 22 so as to extend inwardly of the perforated metal sheet 22 from the surface 22*a* of such perforated metal sheet 22, said recess 37 having a bottom identified by 38. To connect the first and second perforated metal sheets 21 and 22 together, a welding is effected at the bottom 28 of each of the recesses 37 in the second perforated metal sheet 22 to form the corresponding weld deposit 39 each comprised of a weld fraction extending completely through the second perforated metal sheet 22 in alignment with the associated recess 37 and a weld fraction penetrating a predetermined depth into the first perforated metal sheet 21 as best shown in FIG. 13. The opposite surface of the second perforated metal sheet 22 which is held in contact with the first perforated metal sheet 21, that is, at an interface K, is formed with a plurality of annular grooves 40 each being so positioned as to surround the corresponding weld fraction that is penetrating completely through the second perforated metal sheet 22 in alignment with the associated recess 37.

Also as best shown in FIG. 13, the surface of the first perforated metal sheet 21 at the interface K, that is the surface in contact with the second perforated metal sheet 22, is formed with a plurality of annular grooves 41 each being so positioned as to surround the corresponding weld fraction, that is continued from the weld fraction in the second perforated metal sheet 22 and penetrating into the first perforated metal sheet 21, generally in coaxial and face-to-face relationship with the associated annular groove 40 in the second perforated metal sheet 22. Each of the annular grooves 40 in the second perforated metal sheet 22 is so undersized in radius relative to the corresponding annular groove 41 in the first perforated metal sheet 21 that, when the first and second perforated metal sheets 21 and 22 are laminated together, the annular grooves 40 and 41 partially overlap with each other while generally coaxially confronting with each other. It is to be noted that each annular groove 41 in the first perforated metal sheet 21 is communicated at 42 with the adjacent minute hole 13*a* at the opening thereof on the surface of the first perforated metal sheet 21 adjacent the second perforated metal sheet 22.

The finely perforated, laminated shadow mask 7 employing the first and second perforated metal sheets 21 and 22 of the construction according to the third preferred embodiment of the present invention can be fabricated in the following manner.

Each of metal sheets which eventually form the respective first and second perforated metal sheets 21 and 22 is coated with a resist layer of predetermined thickness on both surfaces thereof. Subsequently, an image corresponding to one surfaee of each of the metal sheets which image is depicted by the use of an automatic image drawing machine is exposed to the resist layers on each of the metal sheets, followed by the removal of unwanted portions of the resist layers.

Thereafter, by the use of a chemical etching technique, portions of the metal sheets corresponding in position to the minute holes 13*a* and 13*b*, the recesses 37, the annular grooves 40 and 41 and the positioning holes (shown by 25 in FIG. 5) are etched out to complete the formation of the perforated metal sheets 21 and 22.

Then, the first and second perforated metal sheets 21 and 22 so formed and held in contact with each other at the interface K formed with the annular grooves 40 and 41 are placed on the positioning jig 27 (FIG. 5) with the positioning pins 26 passed through the respective positioning holes in each of the first and second perforated metal sheets 21 and 22 to keep the minute holes 13*a* in the first perforated metal sheet 21 in register with the minute holes 13*b* in the second perforated metal sheet 22, followed by the welding which is effected by the use of an electron beam welding machine. As described hereinbefore, the welding is effected by radiating the electron beams at the bottom 38 of each of the recesses 37 in the second perforated metal sheet 22 to form the corresponding weld deposit 39 each comprised of the weld fraction extending completely through the second perforated metal sheet 22 in alignment with the associated recess 37 and the weld fraction penetrating a predetermined depth into the first perforated metal sheet 21 as best shown in FIG. 13. The radiation of the electron beams during the welding process is continued until each weld deposit can be formed in a quantity necessary to permit it to penetrate completely through the second perforated metal sheet 22 generally in alignment with the associated recess 37 and then into the first perforated metal sheet 21 across the interface K, thereby forming the weld fraction in the second perforated metal sheet 22 and the contiguous weld fraction in the first perforated metal sheet 21. When the application of the electron beam is interrupted, each weld deposit W can be solidified to firmly connect the first and second perforated metal sheets 21 and 22 together, thereby completing the finely perforated, laminated shadow mask 7.

In order to accurately determine the amount of melted metal which eventually form each weld deposit 39 during the performance of the welding by the use of the electron beam welding machine, the amount of energies of the electron beam radiated by the welding machine is carefully selected.

Other component parts of the finely perforated, laminated shadow mask according to the third preferred embodiment of the present invention than that described above are identical with those shown in and described with reference to FIG. 8 and, therefore, the details thereof will not be reiterated for the sake of brevity.

In the practice of the third preferred embodiment of the present invention, welding stresses tend to be induced as each weld deposit 39 is solidified. However, the amount of melted metal which eventually form the corresponding weld deposit 39 corresponds to the wall thickness t10 of the second perforated metal sheet 22 at each recess 37 and the wall thickness t20 of the first perforated metal sheet 21 thick enough to be melted to connect the first perforated metal sheet 21 to the second perforated metal sheet 22, that is, the quantity necessary to permit the weld deposit 39 to penetrate completely through the second perforated metal sheet 22 generally in alignment with the associated recess 37 and then into the first perforated metal sheet 21 across the interface K in the predetermined depth.

In other words, in the embodiment shown in FIG. 3, each weld deposit W shown therein can connect the first and second perforated metal sheets 21 and 22 if and only if a quantity of metal corresponding to the complete wall thickness t2 of the second perforated metal sheet 22 is fused during the welding as shown therein. At this time, each weld deposit W shown in FIG. 3 represents a cross-sectional shape expressed by $L1/(t2+t3)$ with the weld fraction 32 occupying a relatively large volume. Therefore, during the solidification of the molten metal to form the weld fraction 32, shrinkage takes place with the surrounding metal drawn inwardly of the weld fraction 32, resulting in a development of welding stresses.

On the contrary thereto, according to the third preferred embodiment of the present invention shown in and described with reference to FIGS. 12 to 14, since each weld deposit 39 penetrates completely through the small thickness t10 of the second perforated metal sheet 22 aligned with the associated recess 37 and then into the first perforated metal sheet 21 as hereinbefore fully described, the amount of metal fused during the actual welding can be considerably reduced. Because of this, the solidification of the melted metal to form the corresponding weld deposit 39 will not be accompanied by shrinkage and therefore the amount of welding stresses developed can be considerably reduced.

Also, the annular grooves 40 and 41 defined in the second and first perforated metal sheets 22 and 21 in the manner as hereinbefore described are effective to prevent the welding stresses from propagating radially outwardly of the respective weld deposit 39 and, therefore, any possible deformation of other portion of any one of the first and second perforated metal sheets 21 and 22 than the weld deposit 39 can be advantageously avoided. This in turn brings about an advantage in that any possible deformation of the laminated finely perforated, laminated shadow mask 7 according to the third preferred embodiment of the present invention can be minimized.

Again, since each annular groove 40 defined in the second perforated metal sheet 22 is formed so as to communicate with the adjacent minute hole 13*a* through the annular groove 41 defined in the first perforated metal sheet 21, gaseous impurities entering into the annular grooves 40 and 41 during the welding can be easily and positively discharged to the outside through the associated minute holes 13*a* and 13*b*, that is, the aperture 13 of the resultant finely perforated, laminated shadow mask 7, before the finely perforated, laminated shadow mask 7 is mounted inside the evacuated envelope of the color cathode ray tube. Therefore, there is no possibility that some of the gaseous impurities may remain within the evacuated envelope and, accordingly, the envelope can be kept evacuated to a predetermined vacuum at all times with the lifetime thereof consequently improved.

Figure 15:
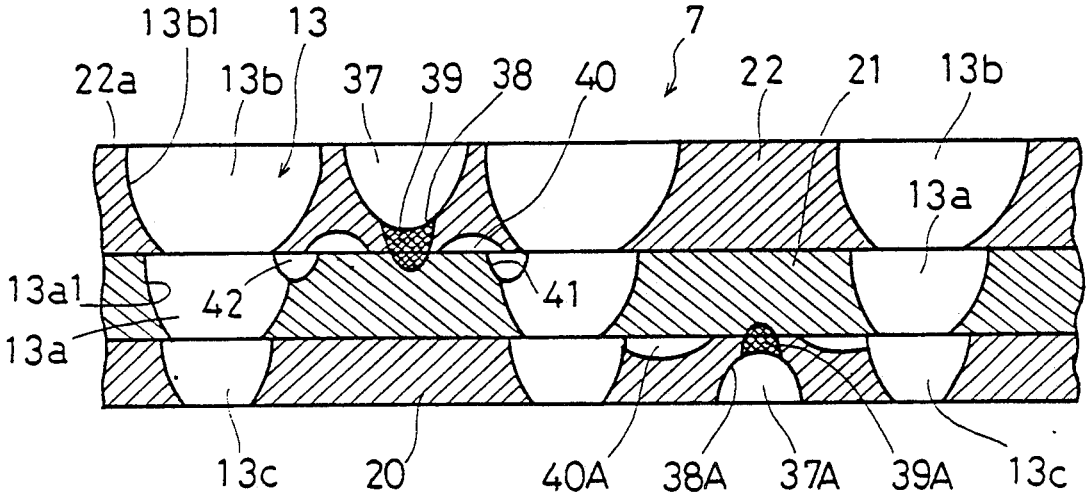
FIG. 15 is a view similar to FIG. 13, showing a modification of the third preferred embodiment of the present invention.

In the practice of the third preferred embodiment of the present invention, more than the two perforated metal sheets 21 and 22 may be employed. An example of the finely perforated, laminated shadow mask utilizing three perforated metal sheets 20, 21 and 22 is shown in FIG. 15. Even the finely perforated, laminated shadow mask 7 utilizing the three perforated metal sheets 20 to 22 connected together in a manner similar to that shown in and described with reference to FIGS. 12 to 14 can bring about effects similar to those brought about by the finely perforated, laminated shadow mask employing the two perforated metal sheets 21 and 22. It is to be noted that, in FIG. 15, reference numeral 37A represents one of a plurality of recesses defined in the perforated metal sheet 20; reference numeral 38A represents the bottom of any one of the recesses 37A; and reference numeral 39A represents one of a plurality of weld deposits used to connect the perforated metal sheets 20 and 21 together in a manner similar to the weld deposit 39. The perforated metal sheets 20 to 22 may have respective thickness similar to those discussed in connection with the embodiment of FIG. 9 and so do the respective widths of the minute holes 13*a*, 13*b* and 13*c* defined in the respective perforated metal sheets 21, 22 and 20.

Yet, in the third preferred embodiment shown in and described with reference to FIGS. 12 to 14, each aperture 13 in the finely perforated, laminated shadow mask 7 has been shown and described as communicated through an opening 42 with the adjacent annular groove 41 defined in the first perforated metal sheet 21, that is, each annular groove 40 in the second perforated metal sheet 22 has been shown and described as undersized relative to the associated annular groove 41 in the first perforated metal sheet 21. However, each opening 42 may be formed to directly communicate the annular groove 40 with the associated hole 13*b* while the annular groove 41 has no openings. Alternatively, the openings 42 may be formed one for each of the annular grooves 40 and 41. Even these alternatives can provide effects similar to those brought about by the illustrated third embodiment of the present invention.

Figure 16:
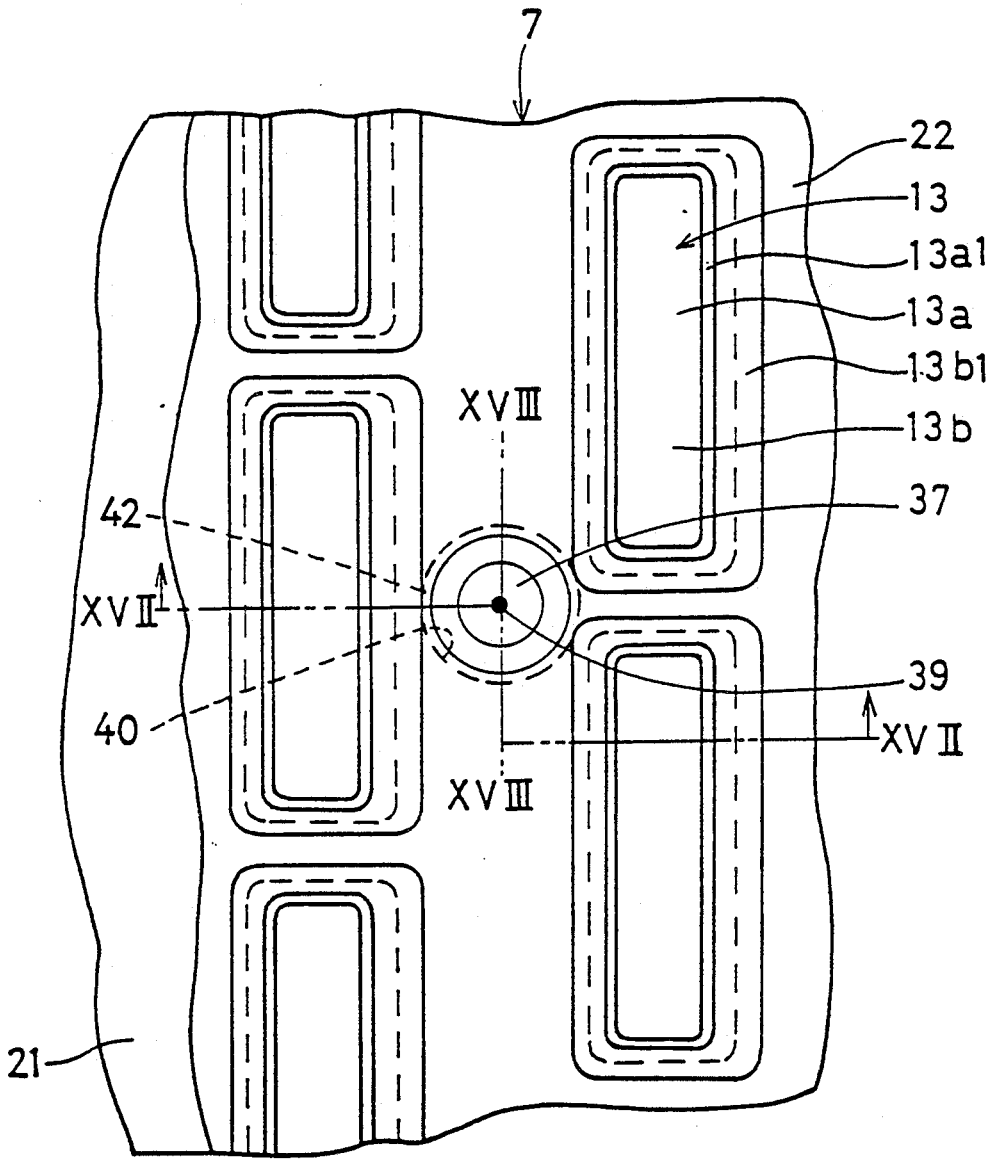
FIG. 16 is an exaggerated plan view of a portion of the finely perforated, laminated shadow mask according to a fourth preferred embodiment of the present invention.
Figure 17:
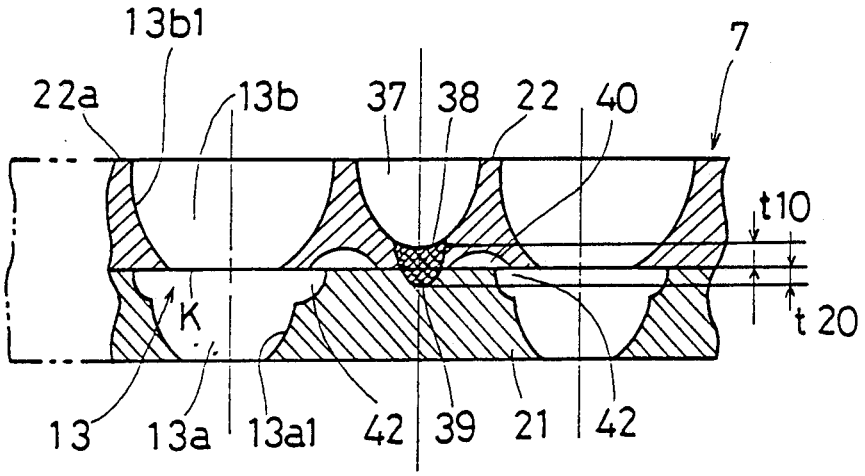
FIG. 17 is a cross-sectional view taken along the line XVII—XVII in FIG. 16.
Figure 18:
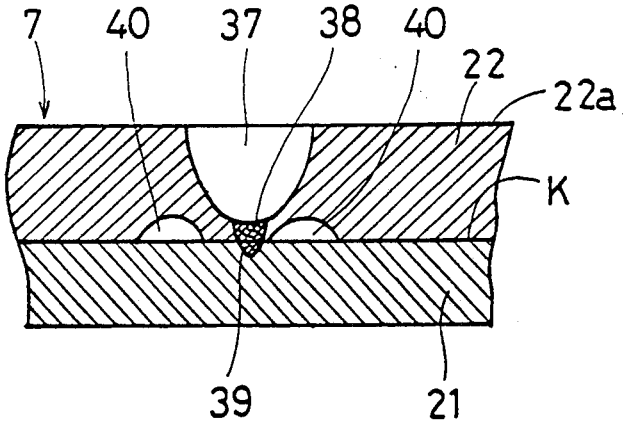
FIG. 18 is a cross-sectional view taken along the line XVIII—XVIII in FIG. 16.

FIGS. 16 to 18 illustrates a fourth preferred embodiment of the present invention. According to this fourth preferred embodiment of the present invention, as best shown in FIG. 18, each annular groove 40 surrounding the corresponding weld deposit 39 used to connect the first and second perforated metal sheets 21 and 22 together is formed on the surface of the second perforated metal sheet 22 at the interface K between the first and second perforated metal sheets 21 and 22 in communicatin with the associated minute hole 13*a* in the perforated metal sheet 21 through the opening 42 defined on the surface of the first perforated metal sheet 21 around the minute hole 13*a*.

Even the finely perforated, laminated shadow mask 7 according to the fourth preferred embodiment of the present invention shown in FIGS. 16 to 18 can bring about effects similar to those brought about by the finely perforated, laminated shadow mask 7 according to the previously described third embodiment shown in FIGS. 12 to 14.

Figure 19:
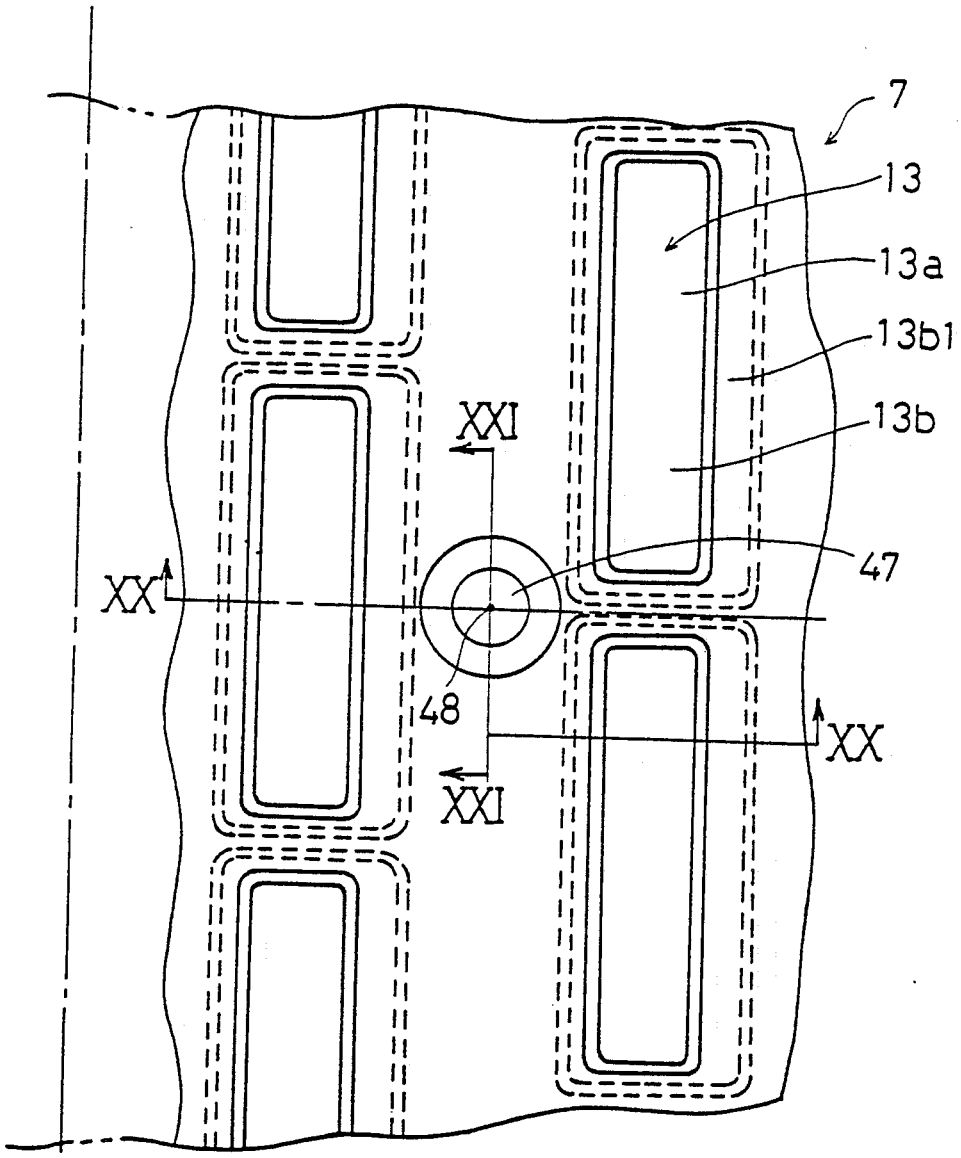
FIG. 19 is an exaggerated plan view of a portion of the finely perforated, laminated shadow mask according to a fifth preferred embodiment of the present invention.
Figure 20A:
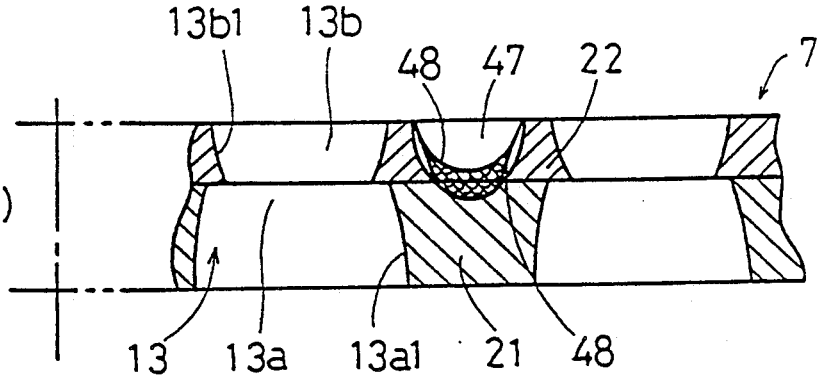
FIGS. 20(*a*) and 20(*b*) show a cross-sectional view taken along the line XX—XX in FIG. 19.
Figure 20B:
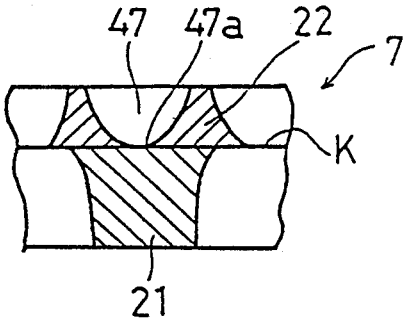
Figure 21:
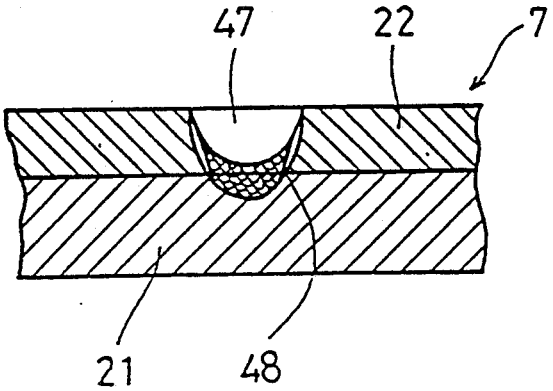
FIG. 21 is a cross-sectional view taken along the line XXI—XXI in FIG. 19.

A fifth preferred embodiment of the present invention is shown in FIGS. 19 to 21 which are an exaggerated plan view of a portion of the finely perforated, laminated shadow mask 7, a cross-sectional view taken along the line XX—XX in FIG. 19 and a cross-sectional view taken along the line XXI—XXI in FIG. 19, respectively.

Referring first to FIG. 20(*b*), one of the perforated metal sheets, for example, the second perforated metal sheet 22, is formed with a plurality of through-holes 47 for the passage therethrough of a welding energy during the welding process, only one of said through-holes 47 being shown in FIGS. 19 to 21. Each of these through-holes 47 is so shaped as to have a relatively large opening open at the surface of the second perforated metal sheet 22 remote from the first perforated metal sheet 21 and confronting the interface K and a reduced diameter opening 47*a* open at the surface of the second perforated metal sheet 22 that confronts the interface K and is held in contact with the first perforated metal sheet 21. The other of the perforated metal sheets, that is, the first perforated metal sheet 21, is held in contact with the second perforated metal sheet 22 at locations generally aligned with the reduced diameter openings 47*a* of the through-holes 47 in the second perforated metal sheet 22.

The first and second perforated metal sheets 21 and 22 are firmly connected together by weld deposits 48, as best shown in FIG. 20(*a*), each of said weld deposits 48 being partly filled in the respective through-hole 47 and partly penetrating through the reduced diameter opening 47*a* into that portion of the first perforated metal sheet 21 which is in alignment with such through-hole 47.

Figure 25:
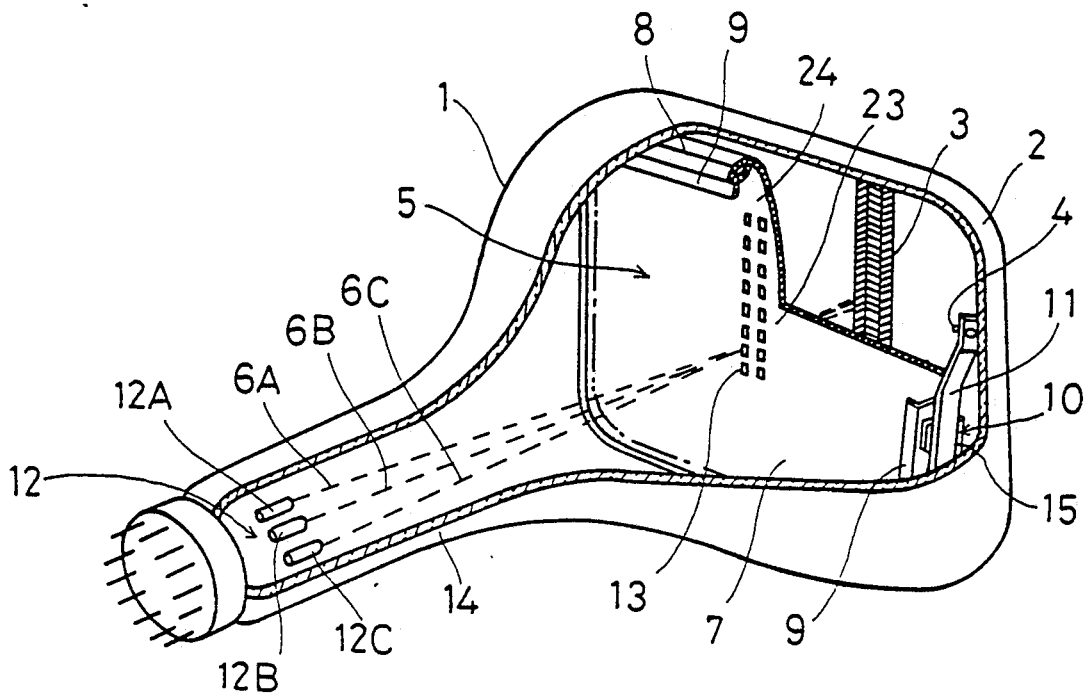
FIG. 25 is a schematic perspective view, with a portion cut away, of the shadow mask color cathode ray tube.
Figure 26:
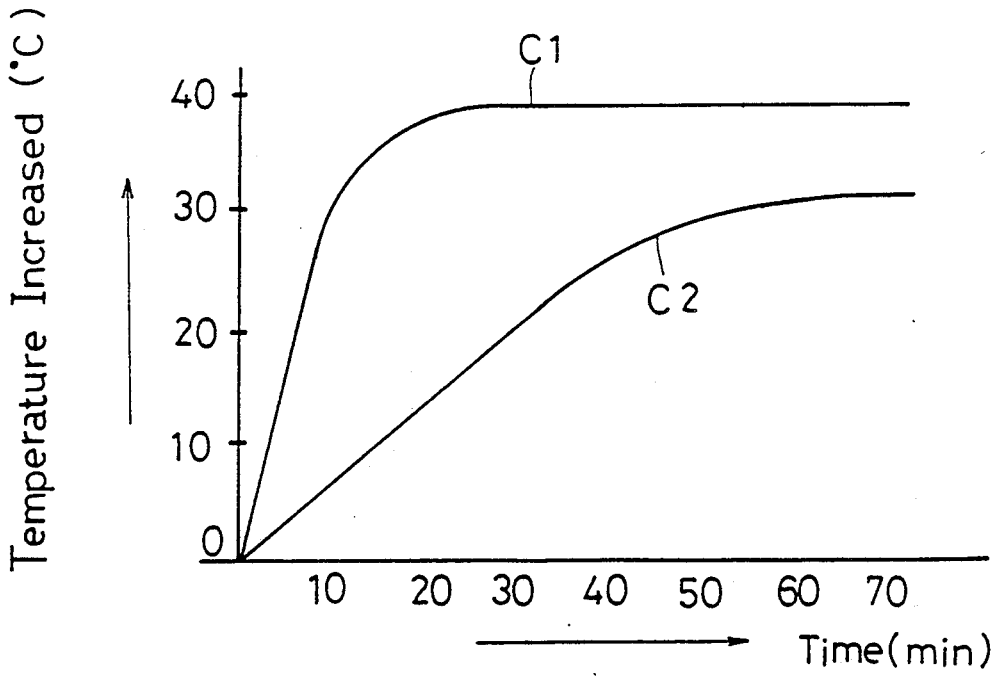
FIG. 26 is a graph showing characteristic curves descriptive of a change in temperature of any one of the perforated shadow mask and the support frame for the support of the perforated shadow mask during the operation of the color cathode ray tube.
Figure 27:
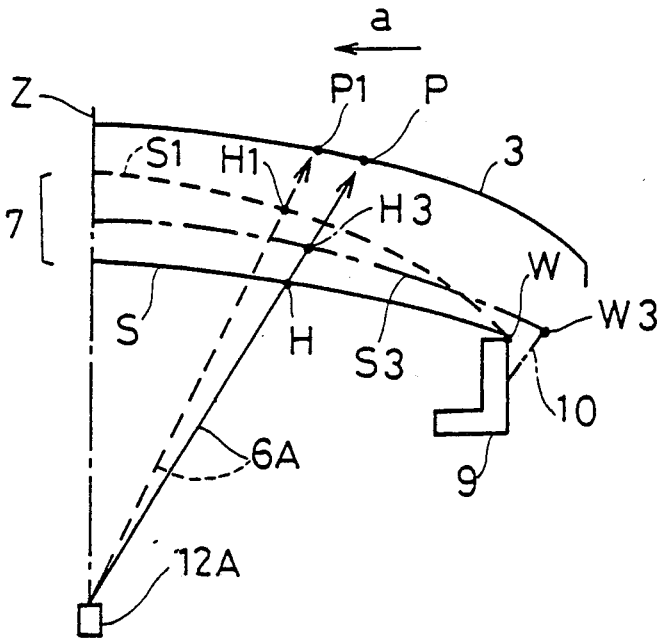
FIG. 27 is a schematic line drawing showing the doming phenomenon occurring in the perforated shadow mask and the method of compensating for the displacement in the color cathode ray tube.
Figure 28:
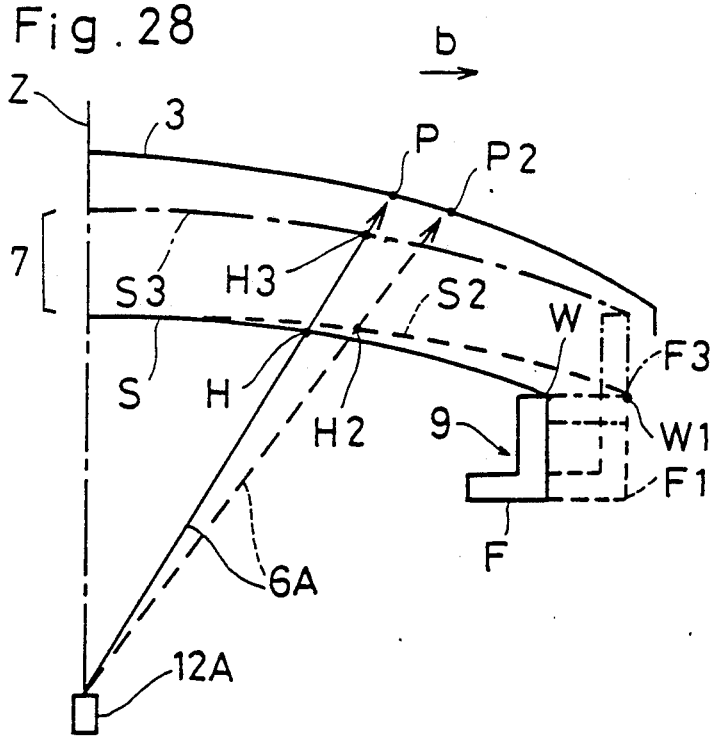
FIG. 28 is a schematic line drawing showing the occurrence of the mislanding of the electron beams resulting from the thermal expansion of the support frame and the method of compensating for the thermal expansion of the support frame.
Figure 31A:
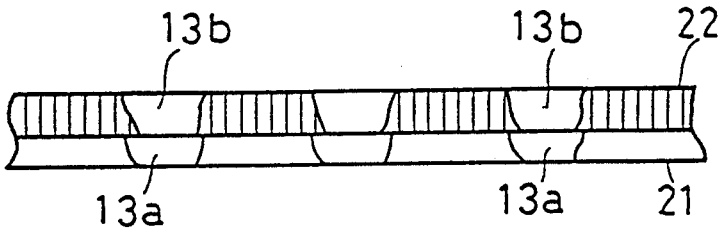
FIGS. 31(*a*) to 31(*d*) illustrate the sequence of shaping the prior art perforated shadow mask on an enlarged scale.
Figure 31B:
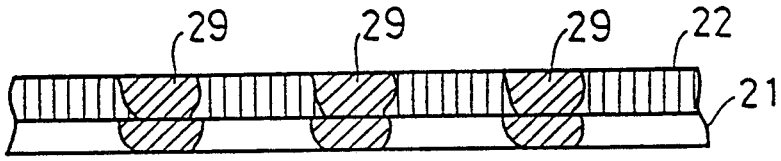
Figure 31C:
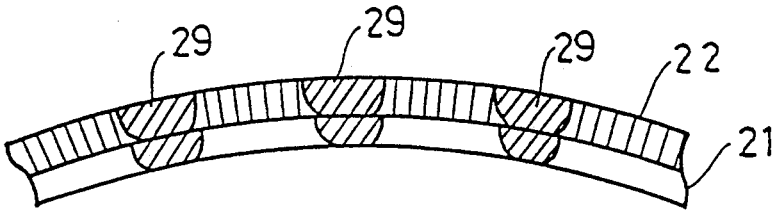
Figure 31D:
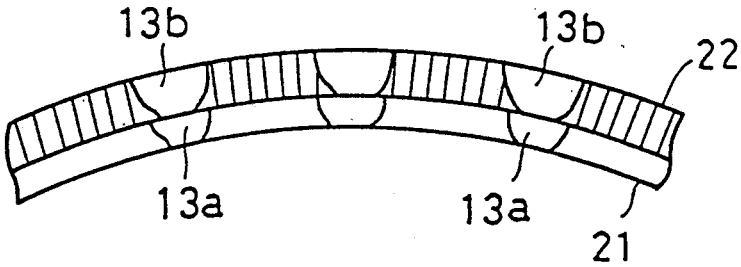

In the illustrated embodiment of FIGS. 19 to 21, the second perforated metal sheet 22 which will be positioned on one side of the first perforated metal sheet 21 close to the phosphor deposited screen 3 (FIG. 25) has a wall thickness smaller than that of the first perforated metal sheet 21 which will be positioned close to the electron gun assembly 12 (FIG. 25). Because of this, the minute holes 13*b* defined in the second perforated metal sheet 22 are undersized in width relative to the minute holes 13*a* defined in the first perforated metal sheet 21.

Other than the employment of the through-holes 47 in the second perforated metal sheet 22, the finely perforated, laminated shadow mask 7 according to the fifth preferred embodiment of the present invention is substantially identical with that shown in and described with reference to FIGS. 12 to 14 and, therefore, the details thereof are not reiterated for the sake of brevity.

In the meanwhile, according to the first mentioned embodiment shown in and described with reference to FIG. 3, the weld fraction 32 of each weld deposit W is relatively large in size and so large that the weld fraction 32 may protrude outwardly from the second perforated metal sheet 22. In contrast thereto, according to the fifth preferred embodiment shown in and described with reference to FIGS. 19 to 21, the provision has been made of the through-holes 47 through which the welding is effected to connect the first and second perforated metal sheets 21 and 22 firmly together, resulting in forming small weld deposits 48. Consequently, the possibility of the welding stresses being built up can also be substantially eliminated. There is also no possibility that the weld deposits 48 may protrude outwardly from the surface of the second perforated metal sheet 22 because each through-hole 47 is so sized as to completely accommodate a portion of the weld deposit 48 within the through-hole 37. Therefore, cut-off work of protrusions after welding is not required.

A sixth preferred embodiment of the present invention will now be described with particular to FIGS. 22 to 24. As is the case with FIGS. 19 to 21 illustrating the fifth embodiment of the present invention, FIGS. 22 to 24 illustrate an exaggerated plan view of a portion of the finely perforated, laminated shadow mask 7, a cross-sectional view taken along the line XXIII—XXIII in FIG. 22 and a cross-sectional view taken along the line XXIV—XXIV in FIG. 22, respectively.

According to the sixth preferred embodiment of the present invention, the first perforated metal sheet 21 positioned on one side of the second perforated metal sheet 22 remote from the phosphor deposited screen 3 (FIG. 25) has a relatively large wall thickness t1, for example, 0.2 mm, so that the first perforated metal sheet 21 can reinforce or back up the second perforated metal sheet 22 when the both are welded together, which second perforated metal sheet 22 has a relatively small wall thickness t2 which is, in the instance as shown, 0.13 mm.

Figure 22:
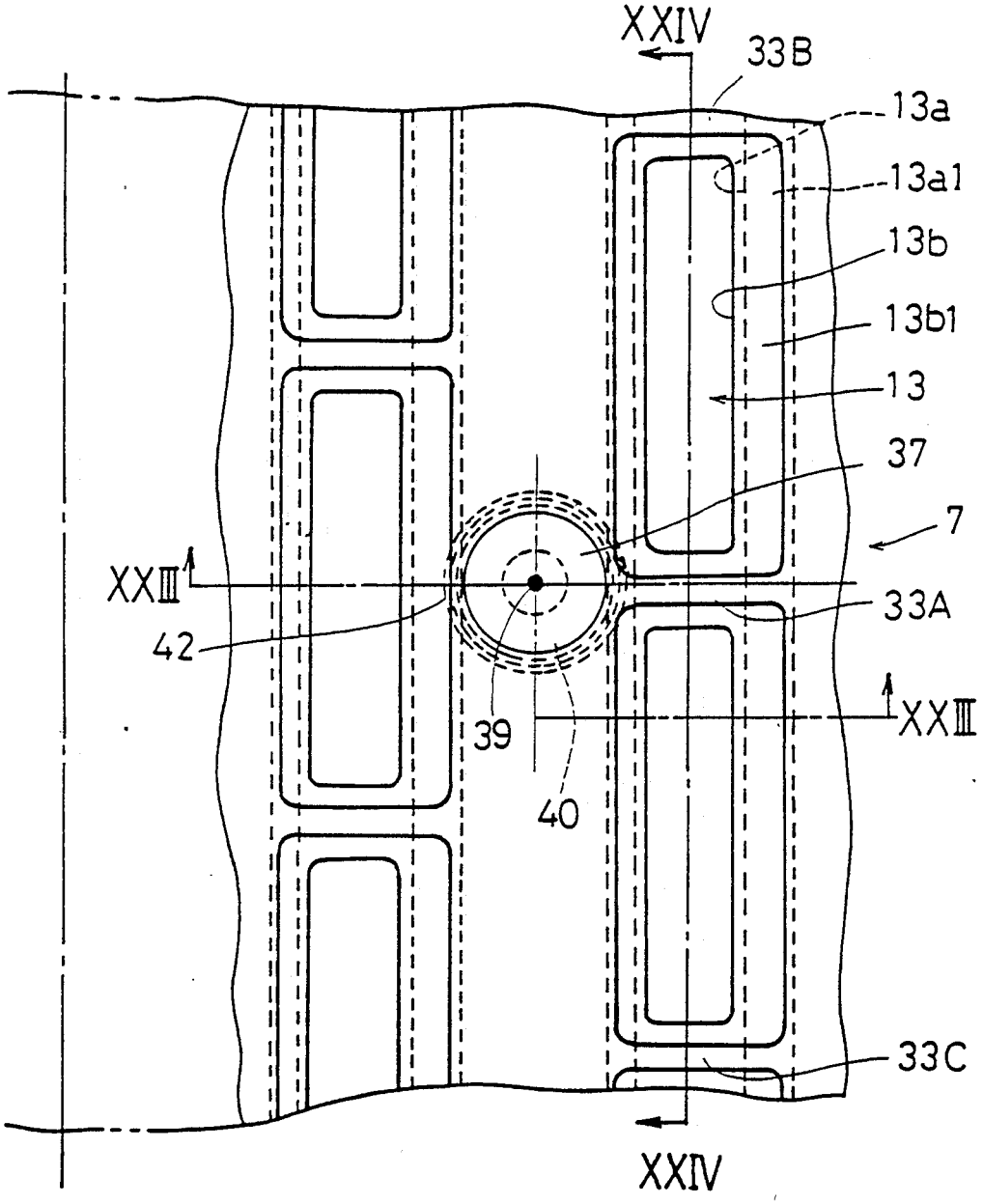
FIG. 22 is an exaggerated plan view of a portion of the finely perforated, laminated shadow mask according to a sixth preferred embodiment of the present invention.
Figure 23:
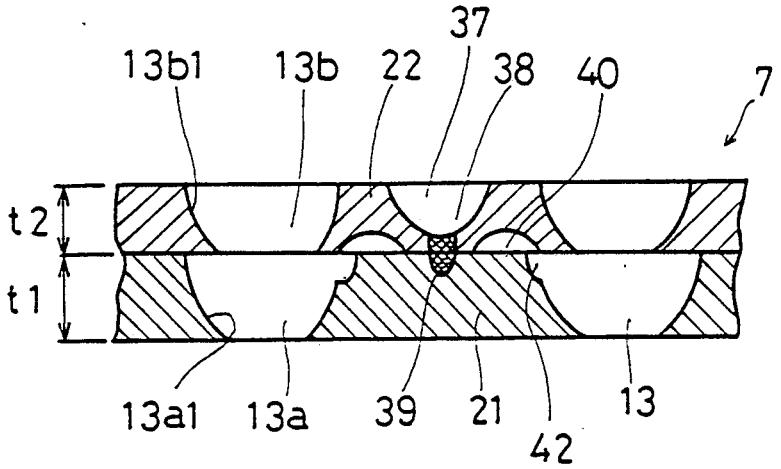
FIG. 23 is a cross-sectional view taken along the line XXIII—XXIII in FIG. 22.
Figure 24:
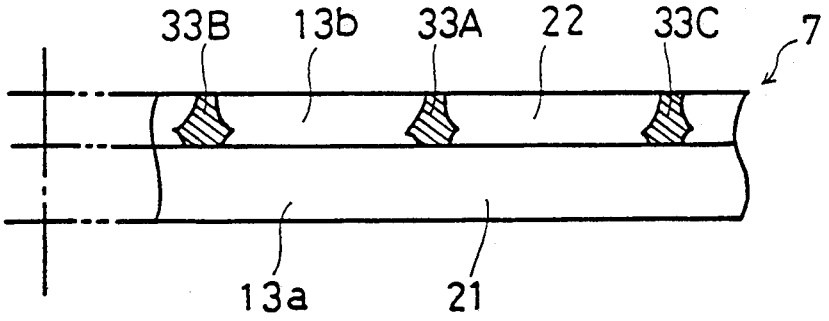
FIG. 24 is a cross-sectional view taken along the line XXIV—XXIV in FIG. 22.

As best shown in FIGS. 22 and 24, the minute holes 13*b* in the second perforated metal sheet 22 each having a relatively small width are delimited by bridges 33A, 33B and 33C which are portions of the metal sheet 22 that are left unremoved when the metal sheet 22 are perforated to provide the minute holes 13*b*. On the other hand, the minute holes 13*a* defined in the first perforated metal sheet 21 are in the form of elongated slots each extending from one side to the opposite side of the perforated area 23 of the first perforated metal sheet 21, and is not delimited by any bridge. Each minute hole 13*b* in the second perforated metal sheet 22 has width so selected as to be smaller than that of the corresponding minute hole or elongated slot in the first perforated metal sheet 21. Accordingly, the passage of the electron beams through the apertures 13 in the finely perforated, laminated shadow mask 7 is essentially restricted by the minute holes 13*b* defined in the second perforated metal sheet 22 forming a part of such finely perforated, laminated shadow mask 7.

Other than the shape of the minute holes or elongated slots 13*a* in the first perforated metal sheet 21, the finely perforated, laminated shadow mask 7 according to the sixth preferred embodiment of the present invention is substantially identical with that according to the fourth embodiment shown in and described with reference to FIGS. 16 to 18 and, therefore, the details thereof will not be reiterated for the sake of brevity.

It is to be noted that, where the minute holes 13*a* and 13*b* in the first and second perforated metal sheets 21 and 22 are formed by the use of the chemical etching technique, the bridge 33A, 33B and 33C tend to have a relatively large width if both of the metal sheets 21 and 22 have a large thickness. In view of this, and since in the sixth embodiment of the present invention the second perforated metal sheet 22 has a thickness smaller than that of the first perforated metal sheet 21 as hereinbefore discussed, the bridges 33A, 33B and 33C delimiting the minute holes 13*b* in the second perforated metal sheet 22 can have a relatively reduced width. Therefore, the permeability of the electron beams through the apertures 13 in the finely perforated, laminated shadow mask 7 can be increased, which in turn enhances the luminance of the phosphor deposited screen.

With respect to the relative position between the minute holes 13*a* in the first perforated metal sheet 21 and the minute holes 13*b* in the second perforated metal sheet 21, the first and second perforated metal sheets 21 and 22 are so positioned and so aligned that the electron beams traveling towards the phosphor deposited screen 3 (FIG. 25) and subsequently restricted by the minute apertures 13*b* of relatively small width in the second perforated metal sheet 22 will not impinge upon the peripheral walls 13*a*1 and 13*b*1 defining the respective minute holes 13*a* and 13*b*. Also, to minimize any possible thermal deformation, the apertures 13 in the finely perforated, laminated shadow mask 7 are reduced in size and, to maximize the weight of the finely perforated, laminated shadow mask 7 itself, the minute holes 13*b* in the second perforated metal sheet 22 are so positioned relative to the minute holes 13*a* in the first perforated metal sheet 21 along the path of travel of the electron beams towards the phosphor deposited screen. Accordingly, as is the case with any conventional color cathode ray tubes, relative positioning between the minute hole 13*a* in the first sheet 21 and the minute hole 13*b* in the second sheet 22 in the horizontal direction and/or the vertical direction tends to be displaced at each of the four corner areas of the screen where the angle of deflection of the electron beams is relatively large.

Moreover, according to the sixth preferred embodiment of the present invention, since no bridge is formed in the first perforated metal sheet 21 having a greater thickness than the second perforated metal sheet 22, no stress tending to induce a deformation will be developed in the first perforated metal sheet 21 when the stack of the first and second perforated metals 21 and 22 are pressed to represent a generally spherical shape and, therefore, the press work can be easily and stably performed to the stack of the first and second perforated metal sheets 21 and 22 to complete the finely perforated, laminated shadow mask 7.

In describing any one of the first to sixth preferred embodiments of the present invention, either the laser beam or the electron beam welding machine can be satisfactorily used to connect the first and second perforated metal sheets 21 and 22 firmly together. In addition, although in describing any one of the first to sixth preferred embodiments of the present invention reference has been made to the use of the expansion compensating couplings 10 (FIG. 25) having the bimetal piece in the perforated shadow mask assembly 5 for coupling the finely perforated, laminated shadow mask 7 with the support frame 9, any other known couplings without the bimetal piece may be employed in the practice of the present invention.

Moreover, the positioning holes 25 shown in FIG. 5 may be formed in each of the first and second perforated sheet metals 21 and 22 at respective locations relatively confronting the phosphor deposited screen 3, however, it is preferred that the positioning holes 25 be formed in the first and second perforated metal sheets 21 and 22 at respective locations situated in a peripheral edge portion of each of the first and second metal sheets 21 and 22 which eventually forms the skirt 8 of the resultant finely perforated, laminated shadow mask 7.

As hereinbefore fully described, according to any one of the foregoing preferred embodiments of the present invention, the finely perforated, laminated shadow mask for use in the color cathode ray tube or any other picture tube comprises a plurality of perforated metal sheets to render the finely perforated, laminated shadow mask to have a substantial thickness enough to withstand against any possible thermal deformation, particularly any possible localized thermal deformation, which would otherwise result in a color misalignment, thereby to improve the color purity. Also, since the stack of the plural perforated metal sheets rigidly connected together can be shaped to any desired shape appropriate for the finely perforated, laminated shadow mask for use in the color cathode ray tube or any other picture tube, the color cathode ray tube or any other picture tube can exhibit a relatively high resolution.

Moreover, the first and second perforated metal sheets are welded firmly together by means of the plural weld deposits formed within the perforated area of each of the first and second perforated metal sheets to complete the finely perforated, laminated shadow mask and, therefore, any possible displacement of the minute holes in one of the perforated metal sheets relative to the minute holes in the other of the perforated metal sheets can be advantageously avoided.

According to any one of the third and fourth preferred embodiment of the present invention, the adjoining perforated metal sheets are welded firmly together by means of weld deposits formed in part in the recesses defined in one of the perforated metal sheets and in part penetrating in the other of the perforated metal sheets. Instead of the provision of the recess, the fifth preferred embodiment of the present invention employs the through-holes defined in one of the perforated metal sheets so as to extend completely through the thickness of such one of the perforated metal sheets, in which through-holes are deposited the respective weld deposits, acting to connect the other of the perforated metal sheets firmly together with such one of the perforated metal sheets. In either case, the volume of melt which eventually form each weld deposit is advantageously minimized and, therefore, any possible deformation of the subsequently completed finely perforated, laminated shadow mask attributable to the welding stresses can be minimized.

Furthermore, according to any one of the third and fourth preferred embodiments of the present invention, any impurity gases which would be generated during the welding of the perforated metal sheets together to provide the finely perforated, laminated shadow mask can be discharged to the outside through the annular grooves, then through the openings and finally through the minute holes defined in either one of the perforated metal sheets. Therefore, the highly evacuated condition, that is, a substantial vacuum, within the envelope of the color cathode ray tube can be maintained thereby to prolong the lifetime of the color cathode ray tube.

Yet, according to any one of the third, fourth and sixth preferred embodiments of the present invention, the provision has been made of the annular grooves each surrounding the associated weld deposit necessitated to connect the perforated metal sheets together and, therefore, any possible force resulting from the welding stresses can be advantageously prevented from propagating away therefrom to the other portion of any one of the perforated metal sheets thereby to minimize any possible deformation of the resultant finely perforated, laminated shadow mask.

Finally, according to the sixth preferred embodiment of the present invention, since one of the perforated metal sheets having a thickness greater than that of the other of the perforated metal sheets has no bridge formed therein, an unnecessary deformation will not occur in the thicker perforated metal sheet during the shaping process carried out by the use of the press work.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, although reference has been made to the generally rectangular shape occupied by the perforated shadow mask assembly including the finely perforated, laminated shadow mask made up of the plural perforated metal sheets, the concept of the present invention can be equally applicable to the perforated shadow mask assembly of any suitable shape, for example, a circular shape.

Accordingly, such changes and modifications are, unless they depart from the spirit and scope of the present invention as delivered from the claims annexed hereto, to be construed as included therein.

What is claimed is:

1. A laminated shadow mask assembly for use in a color picture tube including an evacuated envelope having a longitudinal axis and also having a phosphor deposited screen lying generally perpendicular to the longitudinal axis, which assembly comprises:

a finely perforated, laminated shadow mask having a plurality of apertures defined therein in a predetermined pattern;

a support frame for the support of the laminated shadow mask; and expansion compensating couplings disposed around the support frame for connecting the support frame in position within the evacuated envelope with the laminated shadow mask held generally parallel to the phosphor deposited screen, said expansion compensating couplings being operable to compensate for a thermal expansion of the laminated shadow mask assembly thereby to compensate for a color displacement;

said finely perforated, laminated shadow mask comprising at least two perforated metal sheets each having a perforated area having minute holes defined therein and also having a non-perforated area, said minute holes in both of the perforated metal sheets forming the apertures in the finely perforated, laminated shadow mask when combined together;

said perforated metal sheets being connected together by means of plurality of weld deposits formed at least within the perforated areas thereof to connect said perforated metal sheets firmly together.

2. The laminated shadow mask assembly as claimed in claim 1, wherein said weld deposits are formed in at least two circumferential rows within the perforated areas of the perforated metal sheets.

3. The laminated shadow mask assembly as claimed in claim 1, wherein weld deposits are formed in a circumferential row within the non-perforated areas of the perforated metal sheets in the vicinity of the perimeter between the perforated and non-perforated areas.

4. The laminated shadow mask assembly as claimed in claim 1, wherein one of the perforated metal sheets has a plurality of recesses formed within the perforated area thereof, said weld deposits being formed in part within the recesses; annular grooves defined in one of opposite surfaces of one of the perforated metal sheets, which is held in contact with the other of the perforated metal sheet, so as to surround the associated weld deposits.

5. The laminated shadow mask assembly as claimed in claim 4, further comprising openings for communicating the annular grooves with the respective minute holes.

6. The laminated shadow mask assembly as claimed in claim 1, wherein one of the perforated metal sheets has a plurality of recesses formed within the perforated area thereof, said weld deposits being formed in part within the recesses; first annular grooves defined in one of opposite surface of one of the perforated metal sheets, which is held in contact with the other of the perforated metal sheet, so as to surround the associated weld deposits; second annular grooves defined in one of opposite surfaces of the other of the perforated metal sheets, which is held in contact with such one of the perforated metal sheets, both of the annular grooves being partially overlapped with each other; and openings for communicating the annular grooves in at least one of the perforated metal sheets with the respective minute holes in such one of the perforated metal sheets.

7. A laminated shadow mask assembly for use in a color picture tube including an evacuated envelope having a longitudinal axis and also having a phosphor deposited screen lying generally perpendicular to the longitudinal axis, which assembly comprises:

a finely perforated, laminated shadow mask having a plurality of apertures defined therein in a predetermined pattern;

a support frame for the support of the laminated shadow mask; and expansion compensating couplings disposed around the support frame for connecting the support frame in position within the evacuated envelope with the laminated shadow mask held generally parallel to the phosphor deposited screen, said expansion compensating couplings being operable to compensate for a thermal expansion of the laminated shadow mask assembly thereby to compensate for a color displacement;

said finely perforated, laminated shadow mask comprising at least two perforated metal sheets each having a perforted area having minute holes defined therein and also having a non-perforated area, said minute holes in both of the perforated metal sheets forming the apertures in the finely perforated, laminated shadow mask when combined together;

one of said perforated metal sheets having a plurality of through-hole defined therein across the thickness of such one of the perforated metal sheets, each of said through-holes having a large diameter opening open at one of opposite surface of such one of the perforated metal sheets remote from the other of the perforated metal sheets and also having a reduced diameter opening open at the other of the opposite surface of such one of the perforated metal sheets that is held in contact with the other of the perforated metal sheets;

said perforated metal sheets being connected together by means of a plurality of weld deposits formed within the through-holes and penetrating into such other of the perforated metal sheets to connect said perforated metal sheets firmly together.

8. The laminated shadow mask assembly as claimed in claim 7, wherein said perforated metal sheets being connected together by means of a plurality of weld deposits formed within the perforated areas thereof.

9. A laminated shadow mask assembly for use in a color picture tube including an evacuated envelope having a longitudinal axis and also having a phosphor deposited screen lying generally perpendicular to the longitudinal axis, which assembly comprises:

a finely perforated, laminated shadow mask having a plurality of apertures defined therein in a predetermined pattern;

a support frame for the support of the laminated shadow mask; and expansion compensating couplings disposed around the support frame for connecting the support frame in position within the evacuated envelope with the laminated shadow mask held generally parallel to the phosphor deposited screen, said expansion compensating couplings being operable to compensate for a thermal expansion of the laminated shadow mask assembly thereby to compensate for a color displacement;

said finely perforated, laminated shadow mask comprising at least two perforated metal sheets each having a perforated area having minute holes defined therein and also having a non-perforated area, said minute holes in both of the perforated metal sheets forming the apertures in the finely perforated, laminated shadow mask when combined together;

one of said perforated metal sheets having a wall thickness greater than the others of said perforated metal sheets, only any of the thinner perforated metal sheets having a plurality of bridges formed therein;

said perforated metal sheets being connected together by means of a plurality of weld deposits to connect said perforated metal sheets firmly together;

each of said perforated metal sheets having annular grooves formed therein so as to surround the corresponding weld deposits.

10. The laminated shadow mask assembly as claimed in claim 9, wherein said perforated metal sheets are connected together by means of a plurality of weld deposits formed within the perforated areas thereof.

* * * * *